US008808476B2

(12) United States Patent
Mendenhall et al.

(10) Patent No.: US 8,808,476 B2
(45) Date of Patent: Aug. 19, 2014

(54) GAS GENERATING COMPOSITIONS HAVING GLASS FIBERS

(75) Inventors: Ivan V. Mendenhall, Providence, UT (US); Gary K. Lund, Malad City, ID (US)

(73) Assignee: Autoliv Asp, Inc., Ogden, UT (US)

( * ) Notice: Subject to any disclaimer, the term of this patent is extended or adjusted under 35 U.S.C. 154(b) by 1277 days.

(21) Appl. No.: 12/269,333

(22) Filed: Nov. 12, 2008

(65) Prior Publication Data

US 2010/0116384 A1 May 13, 2010

(51) Int. Cl.

| | |
|---|---|
| ***C06B 45/00*** | (2006.01) |
| ***C06B 31/00*** | (2006.01) |
| ***C06B 29/22*** | (2006.01) |
| ***D03D 23/00*** | (2006.01) |
| ***D03D 43/00*** | (2006.01) |

(52) U.S. Cl.
USPC ..... 149/2; 149/45; 149/76; 149/108.4; 149/109.4

(58) Field of Classification Search
USPC ..... 149/2, 45, 76, 108.4, 109.4
See application file for complete search history.

(56) References Cited

U.S. PATENT DOCUMENTS

| | | | | |
|---|---|---|---|---|
| 2,921,521 A | | 1/1960 | La Haye et al. | 102/39 |
| 3,255,281 A | | 6/1966 | Alexander | 264/3 |
| 3,722,354 A | | 3/1973 | Herty, III | 86/1 |
| 3,724,870 A | | 4/1973 | Kurokawa et al. | 280/150 |
| 3,912,561 A | | 10/1975 | Doin et al. | |
| 3,986,908 A | | 10/1976 | Grebert et al. | 149/19.7 |
| 4,000,231 A | | 12/1976 | Peterson | |
| 4,099,376 A | * | 7/1978 | Japs | 60/253 |
| 4,131,051 A | | 12/1978 | Schaffling | 86/1 R |
| 4,246,051 A | | 1/1981 | Garner et al. | |
| 4,300,962 A | | 11/1981 | Stinecipher et al. | |
| 4,349,324 A | | 9/1982 | Neff et al. | |
| 4,608,102 A | | 8/1986 | Krampen et al. | |
| 4,624,126 A | | 11/1986 | Avila et al. | |
| 4,640,711 A | | 2/1987 | Lichti et al. | |
| 4,698,107 A | | 10/1987 | Goetz et al. | |
| 4,714,579 A | | 12/1987 | Boden et al. | |

(Continued)

FOREIGN PATENT DOCUMENTS

| | | |
|---|---|---|
| DE | 3933555 | 2/1991 |
| DE | 4006741 | 8/1991 |

(Continued)

OTHER PUBLICATIONS

Web page, 1995-2008 Cabot Corporation, Overview of CAB-O-SIL® Untreated Fumed Silicas, http://www.cabot-corp.com/cws/businesses.nsf/CWSID/cwsBUS01182001034300PM9596?_OpenDocument, download Oct. 27, 2008, 1 page.

(Continued)

*Primary Examiner* — James McDonough
(74) *Attorney, Agent, or Firm* — Harness, Dickey & Pierce, P.L.C.

(57) ABSTRACT

Compositions and methods relate to gas generants used in inflatable restraint systems. The gas generant grains include a fuel mixture having at least one fuel and at least one oxidizer, which have a burn rate that is susceptible to pressure sensitivity during combustion. The gas generant composition further includes a plurality of pressure sensitivity modifying glass fiber particles distributed therein to lessen the pressure sensitivity and/or to increase combustion stability of the gas generant. Such gas generants can be formed via spray drying techniques.

23 Claims, 7 Drawing Sheets

(56) References Cited

U.S. PATENT DOCUMENTS

| | | | | |
|---|---|---|---|---|
| 4,806,180 | A | 2/1989 | Goetz et al. | |
| 4,817,828 | A | 4/1989 | Goetz | |
| 4,828,474 | A | 5/1989 | Ballantyne | |
| 4,846,368 | A | 7/1989 | Goetz | |
| 4,923,512 | A | 5/1990 | Timm et al. | |
| 4,944,528 | A | 7/1990 | Nilsson et al. | 280/741 |
| 4,948,439 | A | 8/1990 | Poole et al. | |
| 4,998,751 | A | 3/1991 | Paxton et al. | |
| 5,019,220 | A | 5/1991 | Tayler et al. | |
| 5,034,070 | A | 7/1991 | Goetz et al. | |
| 5,035,757 | A | 7/1991 | Poole | |
| 5,051,143 | A | 9/1991 | Goetz | |
| 5,074,938 | A | 12/1991 | Chi | |
| 5,139,588 | A | 8/1992 | Poole | |
| 5,202,067 | A | 4/1993 | Solazzi et al. | |
| 5,351,619 | A | 10/1994 | Chan et al. | |
| 5,388,519 | A | 2/1995 | Guindon et al. | |
| 5,407,608 | A | 4/1995 | Knowlden et al. | |
| 5,423,261 | A | 6/1995 | Bernardy et al. | |
| 5,460,668 | A | 10/1995 | Lyon | |
| 5,507,520 | A | 4/1996 | Meduvsky et al. | |
| 5,507,890 | A | 4/1996 | Swann et al. | |
| 5,518,054 | A | 5/1996 | Mitson et al. | |
| 5,531,941 | A | 7/1996 | Poole | |
| 5,538,568 | A | 7/1996 | Taylor et al. | |
| 5,542,704 | A | 8/1996 | Hamilton et al. | |
| 5,562,303 | A | 10/1996 | Schleicher et al. | 280/736 |
| 5,565,710 | A | 10/1996 | Ochi et al. | |
| 5,608,183 | A | 3/1997 | Barnes et al. | |
| 5,623,115 | A | 4/1997 | Lauritzen et al. | 102/288 |
| 5,629,494 | A | 5/1997 | Barnes et al. | |
| 5,635,668 | A | 6/1997 | Barnes et al. | |
| 5,670,740 | A | 9/1997 | Barnes et al. | |
| 5,738,374 | A | 4/1998 | Marsaud et al. | 280/741 |
| 5,756,929 | A | 5/1998 | Lundstrom et al. | |
| 5,756,930 | A | 5/1998 | Chan et al. | |
| 5,780,767 | A | 7/1998 | Matsuda et al. | |
| 5,804,758 | A | 9/1998 | Marsaud et al. | 102/288 |
| 5,834,679 | A | 11/1998 | Seeger | |
| 5,879,421 | A | 3/1999 | Liu et al. | |
| 5,989,367 | A | 11/1999 | Zeuner | |
| 6,007,736 | A | 12/1999 | Zhang et al. | |
| 6,029,994 | A | 2/2000 | Perotto et al. | 280/736 |
| 6,032,979 | A | 3/2000 | Mossi et al. | 280/741 |
| 6,039,820 | A | 3/2000 | Hinshaw et al. | |
| 6,053,110 | A | 4/2000 | Marchant | |
| 6,103,030 | A | 8/2000 | Taylor | |
| 6,129,023 | A | 10/2000 | Marsaud et al. | |
| 6,132,480 | A | 10/2000 | Barnes et al. | |
| 6,132,537 | A | 10/2000 | Zeuner et al. | |
| 6,143,102 | A | 11/2000 | Mendenhall et al. | |
| 6,156,136 | A | 12/2000 | Bottaro et al. | |
| 6,205,916 | B1 | 3/2001 | Castleton | |
| 6,214,138 | B1 | 4/2001 | Canterberry et al. | |
| 6,224,697 | B1 | 5/2001 | Mendenhall | |
| 6,301,935 | B1 | 10/2001 | Audenaert et al. | |
| 6,315,930 | B1 | 11/2001 | Hamilton | |
| 6,322,649 | B1 | 11/2001 | Marsaud et al. | |
| 6,368,434 | B1 | 4/2002 | Espagnacq et al. | |
| 6,427,599 | B1 | 8/2002 | Posson et al. | |
| 6,517,647 | B1 | 2/2003 | Yamato | 149/45 |
| 6,550,808 | B1 | 4/2003 | Mendenhall | |
| 6,592,691 | B2 | 7/2003 | Taylor et al. | |
| 6,605,233 | B2 | 8/2003 | Knowlton et al. | |
| 6,634,302 | B1 | 10/2003 | Rink et al. | |
| 6,688,231 | B1 | 2/2004 | Herrmann | |
| 6,689,237 | B1 | 2/2004 | Mendenhall | |
| 6,712,918 | B2 | 3/2004 | Mendenhall et al. | |
| 6,752,939 | B2 | 6/2004 | Gereg | |
| 6,789,485 | B2 | 9/2004 | Moquin et al. | 102/530 |
| 6,843,869 | B2 | 1/2005 | Mendenhall et al. | |
| 6,905,562 | B2 | 6/2005 | Hamilton | |
| 6,935,655 | B2 | 8/2005 | Longhurst et al. | |
| 6,941,868 | B2 | 9/2005 | Herget | |
| 6,958,101 | B2 | 10/2005 | Mendenhall et al. | |
| 6,984,398 | B2 | 1/2006 | Brennan et al. | |
| 7,024,342 | B1 | 4/2006 | Waite et al. | |
| 7,077,428 | B2 | 7/2006 | Barker et al. | |
| 7,147,733 | B2 | 12/2006 | Barnes et al. | |
| 7,470,337 | B2 | 12/2008 | Mendenhall et al. | |
| 7,758,709 | B2 | 7/2010 | Hussey et al. | |
| 7,814,838 | B2 | 10/2010 | McCormick | |
| 2002/0195181 | A1 | 12/2002 | Lundstrom et al. | |
| 2003/0037850 | A1 | 2/2003 | Helmy et al. | |
| 2003/0089883 | A1 | 5/2003 | Knowlton et al. | |
| 2004/0000362 | A1 | 1/2004 | Sato et al. | |
| 2004/0050283 | A1 | 3/2004 | Daoud | |
| 2004/0112244 | A1 | 6/2004 | Barker et al. | |
| 2004/0154712 | A1* | 8/2004 | Yokoyama et al. | 149/45 |
| 2004/0173922 | A1 | 9/2004 | Barnes et al. | |
| 2004/0200554 | A1 | 10/2004 | Mendenhall et al. | |
| 2004/0216820 | A1 | 11/2004 | Mendenhall et al. | |
| 2005/0067076 | A1 | 3/2005 | Barnes et al. | |
| 2005/0115721 | A1 | 6/2005 | Blau et al. | |
| 2005/0263223 | A1 | 12/2005 | Halpin et al. | |
| 2006/0016529 | A1 | 1/2006 | Barnes et al. | |
| 2006/0054257 | A1 | 3/2006 | Mendenhall et al. | |
| 2006/0102259 | A1 | 5/2006 | Taylor et al. | |
| 2007/0084531 | A1* | 4/2007 | Halpin et al. | 149/24 |
| 2007/0240797 | A1 | 10/2007 | Mendenhall et al. | |
| 2007/0277915 | A1 | 12/2007 | Hordos | |
| 2007/0296190 | A1 | 12/2007 | Hussey et al. | |
| 2008/0236711 | A1 | 10/2008 | Bradford et al. | |
| 2009/0044885 | A1 | 2/2009 | Brisighella et al. | |
| 2009/0044886 | A1 | 2/2009 | Brisighella | |
| 2009/0255611 | A1 | 10/2009 | Lund et al. | |
| 2009/0308509 | A1 | 12/2009 | Marlin | |
| 2010/0230945 | A1 | 9/2010 | Hussey et al. | |

FOREIGN PATENT DOCUMENTS

| | | |
|---|---|---|
| DE | 19501889 | 7/1995 |
| DE | 4318883 | 12/2003 |
| EP | 0324639 | 7/1989 |
| EP | 0757026 | 6/1996 |
| EP | 0728630 | 8/1996 |
| EP | 0767155 | 4/1997 |
| EP | 0870746 | 4/1998 |
| EP | 1142853 | 10/2001 |
| EP | 2035352 | 11/2009 |
| FR | 2873367 | 1/2006 |
| GB | 2219242 | 12/1989 |
| WO | WO 89/010257 | 11/1989 |
| WO | WO 99/05079 | 2/1999 |
| WO | WO 01/008937 | 2/2001 |
| WO | WO 03/106378 | 12/2003 |
| WO | WO 2004/024653 | 3/2004 |
| WO | WO 2004/067477 | 8/2004 |
| WO | WO 2006/134311 | 12/2006 |
| WO | WO 2007/042735 | 4/2007 |
| WO | WO 2007/113299 | 10/2007 |
| WO | WO 2007/149173 | 12/2007 |
| WO | WO 2008/035288 | 3/2008 |
| WO | WO 2008/051274 | 5/2008 |
| WO | WO 2008/118273 | 10/2008 |
| WO | WO 2009/023119 | 2/2009 |
| WO | WO 2009/126182 | 10/2009 |
| WO | WO 2009/126702 | 10/2009 |
| WO | WO 2010/056512 | 5/2010 |

OTHER PUBLICATIONS

Web page, Fibertec, Inc., Fibertec Functional Fillers—Microglas Milled Glass Fibers, http://www.fibertecinc.com/microglass.htm, downloaded Oct. 27, 2008, 3 pages.

Web page, U.S. Silica Company, MIN-U-SIL® 40, Jan. 7, 1999, Http://www.u-s-silica.com/PDS/Berkeley/BerMUS402000.PDF, downloaded Nov. 10, 2008, 1 page.

"Extrusion Process," [online]; [retrieved on Oct. 6, 2006], retrieved from http://www.aec.org/techinfo/prntFriend/expro_prntfrnd.html, 4 pp.

(56) References Cited

OTHER PUBLICATIONS

"Refinement of tablet compaction models to include compaction kinematics," [online]; [retrieved on Sep. 18, 2006], retrieved from http://www.msm.cam.ac.uk/ccmm/projects/lhh24.html, 6 pp.
"The Use of MADYMO to Elucidate Injury Mechanisms in a Complex, Multiple-Impact Collision," [online]; [retrieved on Feb. 5, 2008], retrieved from http://www-nrd.nhtsa.dot.gov/pdf/nrd-50/ciren/2002/0802fairfax.pdf, 32 pp.
Applicants' Response to communication from the European Examining Division dated Mar. 31, 2010 for European Patent Application No. 07795162.2 (Published as EP 2035352) as filed on Sep. 23, 2010.
Communication from the European Examining Division dated Mar. 31, 2010 for European Patent Application No. 07795162.2 (Published as EP 2035352).
The European Search Opinion and Supplementary European Search Report issued on Oct. 1, 2009 for European Patent Application No. 07795162.2 (Published as EP 2035352).
The International Search Report and Written Opinion of the International Searching Authority issued on Dec. 22, 2009 for International Application No. PCT/US09/62223 (Published as WO 2010/056512).
The International Search Report and Written Opinion of the International Search Authority issued on Sep. 18, 2008 for PCT International Application No. PCT/US08/02654 (Published as WO 08/118273).
The International Search Report and Written Opinion of the International Search Authority issued on Jul. 3, 2008 for PCT International Application No. PCT/US07/12169 (Published as WO 07/149173).
The International Search Report and Written Opinion of the International Search Authority issued on May 18, 2009 for PCT International Application No. PCT/US09/039895 (Published as WO 09/126702).
The International Search Report and Written Opinion of the International Search Authority issued on Sep. 25, 2009 for PCT International Application No. PCT/US08/079750 (Published as WO 09/126182).
The International Search Report and Written Opinion of the International Search Authority issued on Jul. 30, 2009 for PCT International Application No. PCT/US08/009472 (Published as WO 09/023119).

* cited by examiner

GAS GENERATING COMPOSITIONS HAVING GLASS FIBERS

FIELD

The present disclosure generally relates to inflatable restraint systems and more particularly to pyrotechnic gas-generating compositions containing glass fibers for use in such systems.

INTRODUCTION

The statements in this section provide background information related to the present disclosure and may not constitute prior art.

Passive inflatable restraint systems are used in a variety of applications, such as motor vehicles. Certain types of passive inflatable restraint systems minimize occupant injuries by using a pyrotechnic gas generant to inflate an airbag cushion (e.g., gas initiators and/or inflators) or to actuate a seatbelt tensioner (e.g., micro gas generators), for example. Automotive airbag inflator performance and safety requirements continually increase to enhance passenger safety.

Gas generant and initiator material selection involves addressing various factors, including meeting current industry performance specifications, guidelines and standards, generating safe gases or effluents, durational stability of the materials, and cost-effectiveness in manufacture, among other considerations. Further, the pyrotechnic gas generant compositions must be safe during handling, storage, and disposal.

Important variables in inflator gas generant design include improving gas generant performance with respect to gas yield, relative quickness as determined by observed burning rate, and cost. In general, a burn rate for a gas generant composition can be represented by:

$$r_b = k(P)^n \quad \text{(EQN. 1)}$$

where $r_b$ is burn rate (linear); k is a constant; P is pressure, and n is a pressure exponent, where the pressure exponent is the slope of a linear regression line drawn through a logarithmic-logarithmic plot of linear burn rate ($r_b$) versus pressure (P).

One important aspect of a gas generant material's performance is combustion stability, as reflected by its burn rate pressure sensitivity, which is related to the pressure exponent or the slope of the linear regression line of the logarithmic-logarithmic plot of burn rate ($r_b$) versus pressure (P). It is generally desirable to develop gas generant materials which exhibit reduced or lessened burn rate pressure sensitivity, as gas generant materials exhibiting higher burn rate pressure sensitivity can potentially lead to undesirable performance variability, such as when the corresponding material or formulation is reacted under different pressure conditions.

SUMMARY

In various aspects, the present disclosure provides methods for making a gas generant and the compositions produced thereby. In certain aspects, a gas generant composition comprises at least one fuel and at least one oxidizer. Gas generant compositions comprising the at least one fuel and the at least one oxidizer have a burn rate that is susceptible to pressure sensitivity during combustion (in the absence of any pressure sensitivity modifying glass fiber particles). In accordance with the present teachings, the gas generant composition further comprises a plurality of pressure sensitivity modifying glass fiber particles, which optionally comprise at least one compound selected from the group consisting of silicon dioxide, aluminosilicate, borosilicate, calcium aluminoborosilicate, and combinations thereof. In certain aspects, the plurality of pressure sensitivity modifying glass fiber particles comprises calcium aluminoborosilicate glass fibers, which are typically referred to as "E" glass milled fibers. Thus, when the plurality of pressure sensitivity modifying glass fiber particles is included in the gas generant composition, the gas generant has a reduced pressure sensitivity and/or increased combustion stability during combustion as compared to a comparative gas generant (having at least one fuel and at least one oxidizer, but lacking the plurality of pressure sensitivity modifying glass fiber particles). In certain aspects, the gas generant has a linear burn rate pressure exponent of less than or equal to about 0.6 with the pressure sensitivity modifying glass fiber particles.

In other aspects, a gas generant grain comprises a mixture comprising at least one fuel and at least one oxidizer. Such a gas generant grain comprises a mixture having a burn rate that is susceptible to pressure sensitivity during combustion. In certain variations, an oxidizer comprises a primary oxidizer and a secondary oxidizer that comprises a perchlorate-containing compound. The gas generant grain comprises a plurality of pressure sensitivity modifying glass fiber particles distributed in the fuel mixture at greater than or equal to about 1% and less than about 10% by weight, where the plurality of pressure sensitivity modifying glass fibers reduces pressure sensitivity of the fuel mixture during combustion, so that the gas generant composition has a linear burn rate pressure exponent of less than or equal to about 0.6. In certain aspects, such a fuel mixture can comprise guanidine nitrate; a primary oxidizer comprising basic copper nitrate; and a secondary oxidizer selected from an alkali metal perchlorate, an ammonium perchlorate, and combinations thereof.

In yet other aspects, the present disclosure provides a method for lessening burn rate pressure sensitivity in a gas generant, the method comprising introducing a plurality of pressure sensitivity modifying glass fiber particles to a mixture comprising at least one fuel and at least one oxidizer to form the gas generant. In certain aspects, the gas generant has a burn rate that is susceptible to pressure sensitivity during combustion and after introducing the pressure sensitivity modifying glass fibers, the gas generant pressure sensitivity is reduced and/or combustion stability is enhanced. In certain aspects, the gas generant composition has a linear burn rate pressure exponent of less than or equal to about 0.6 during combustion.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

DETAILED DESCRIPTION

Figure 1:
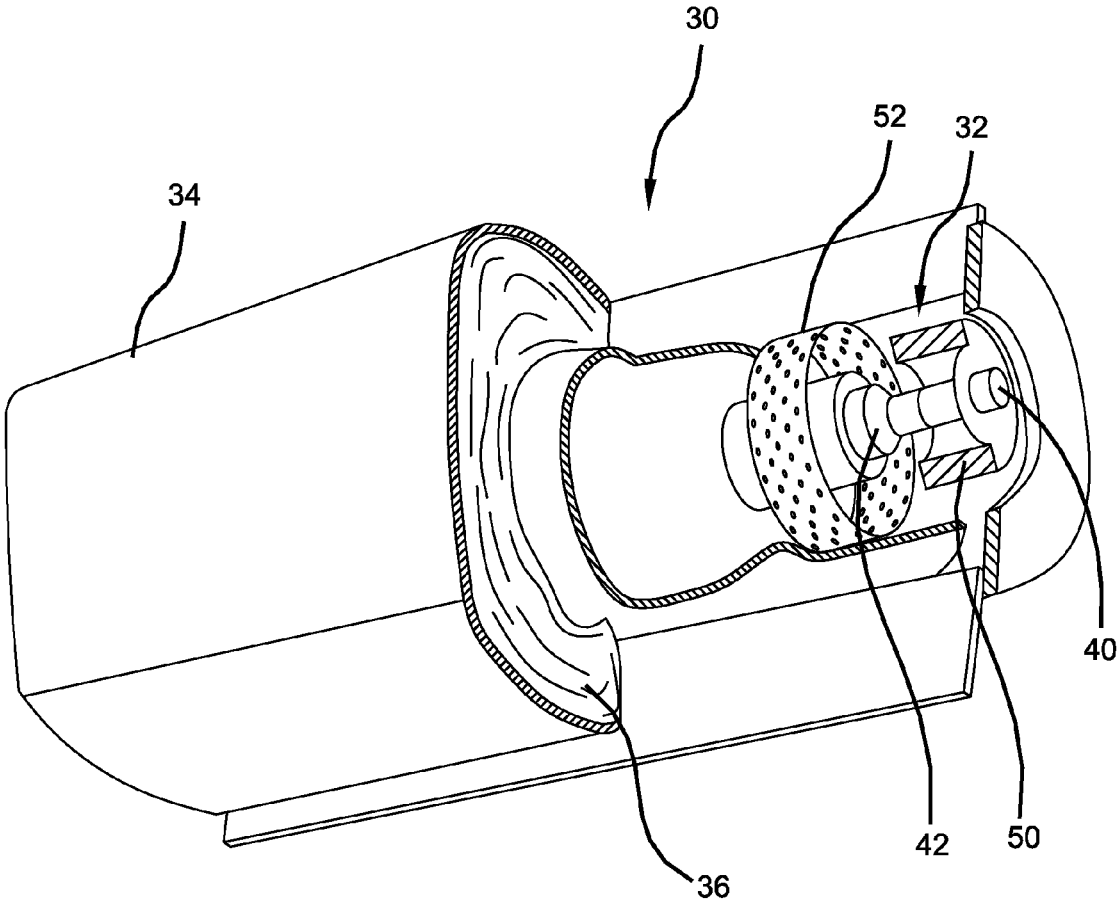
FIG. 1 is a partial cross-sectional view of an exemplary passenger-side airbag module including an inflator for an inflatable airbag restraint device.

The present disclosure is drawn to gas generant compositions and methods for making such gas generant compositions. Gas generants, also known as ignition materials, propellants, gas-generating materials, and pyrotechnic materials are used in inflators of airbag modules, such as a simplified exemplary airbag module 30 comprising a passenger compartment inflator assembly 32 and a covered compartment 34 to store an airbag 36 of FIG. 1. A gas generant material 50 burns to produce the majority of gas products that are directed to the airbag 36 to provide inflation. Such devices often use a squib or initiator 40 which is electrically ignited when rapid deceleration and/or collision is sensed. The discharge from the squib 40 usually ignites an igniter material 42 that burns rapidly and exothermically, in turn, igniting a gas generant material 50.

The gas generant 50 can be in the form of a solid grain, a pellet, a tablet, or the like. Impurities and other materials present within the gas generant 50 facilitate the formation of various other compounds during the combustion reaction(s), including additional gases, aerosols, and particulates. Often, a slag or clinker is formed near the gas generant 50 during burning. The slag/clinker often serves to sequester various particulates and other compounds. However, a filter 52 is optionally provided between the gas generant 50 and airbag 36 to remove particulates entrained in the gas and to reduce gas temperature of the gases prior to entering the airbag 36. The quality and toxicity of the components of the gas produced by the gas generant 50, also referred to as effluent, are important because occupants of the vehicle are potentially exposed to these compounds. It is desirable to minimize the concentration of potentially harmful compounds in the effluent.

Various different gas generant compositions (e.g., 50) are used in vehicular occupant inflatable restraint systems. Gas generant material selection involves various factors, including meeting current industry performance specifications, guidelines and standards, generating safe gases or effluents, handling safety of the gas generant materials, durational stability of the materials, and cost-effectiveness in manufacture, among other considerations. It is preferred that the gas generant compositions are safe during handling, storage, and disposal, and preferably are azide-free.

In various aspects, the gas generant typically includes at least one fuel component and at least one oxidizer component, and may include other minor ingredients, that once ignited combust rapidly to form gaseous reaction products (e.g., $CO_2$, $H_2O$, and $N_2$). One or more compounds undergo rapid combustion to form heat and gaseous products; e.g., the gas generant burns to create heated inflation gas for an inflatable restraint device or to actuate a piston. In certain aspects, the gas generant comprises a redox-couple having at least one fuel component. The gas-generating composition also includes one or more oxidizing components, where the oxidizing component reacts with the fuel component in order to generate the gas product.

In accordance with various aspects of the present disclosure, gas generants are provided that have desirable compositions that result in superior performance characteristics in an inflatable restraint device, while reducing overall cost of gas generant production. In certain aspects, select gas generant compositions may fulfill various desirable criteria for gas generant performance; however, may suffer from combustion instability, such as having a linear burn rate that is susceptible to pressure sensitivity during combustion. Gas generants that exhibit pressure sensitivity during combustion may have variable or fluctuating burn rates during combustion depending on changing pressure conditions causing various potentially detrimental conditions, including variable and potentially unpredictable combustion performance and potentially excessive effluent species. In certain cases, such gas generants may extinguish and potentially re-burn, exacerbating undesirable effects. It is desirable to employ gas generant compositions that have relatively consistent performance during combustion, including burn rates that are relatively independent of pressure (e.g., pressure insensitive).

In various aspects, gas generants of the present disclosure comprise a pyrotechnic mixture comprising at least one fuel and at least one oxidizer that exhibits a burn rate that suffers from undesirable pressure sensitivity during combustion. While all gas generants exhibit some pressure sensitivity, adverse or undesirable pressure sensitivity potentially impacts combustion instability. As referred to herein, "pressure sensitivity" is meant to refer to undesirable pressure sensitivity of a gas generant resulting in combustion variability and instability. By way of example, an increase in pressure sensitivity at lower operating pressures (e.g., less than 1,000 psi) may lead to undesirable combustion instability. To minimize pressure sensitivity, it is desirable to have a gas generant material with a linear burn rate exhibiting a relatively constant slope (a slope of a linear regression line drawn through a logarithmic—logarithmic plot of burn rate ($r_b$) versus pressure (P)) over the range of typical operating pressure for a gas inflator, for example, about 1,000 psi (about 6.9 MPa) to about 5,000 psi (about 34.5 MPa). In various aspects, a gas generant composition is provided that has enhanced combustion stability performance, in particular, a reduced burn rate pressure sensitivity of the gas generant material as it is used in an inflator device.

In certain aspects, a gas generant material having an acceptable pressure sensitivity has a linear burning rate slope of less than or equal to about 0.60, optionally less than or equal to about 0.50. A material having a burn rate slope of less than or equal to about 0.60, optionally less than or equal to about 0.50 fulfills hot to cold performance variation requirements, and can reduce performance variability and pressure requirements of the inflator as well. Thus, in various aspects, it is desirable that the gas generant materials have a constant slope over the pressure range of inflator operation, which is typically about 1,000 psi to about 5,000 psi and desirably has a constant slope that is less than or equal to about 0.60. In this regard the gas generants of the present disclosure have improved pressure sensitivity (i.e., reduced pressure sensitivity) and enhanced combustion performance, for example, by having reduced linear burn rate pressure sensitivity (i.e., a relatively low pressure exponent (n) or slope of a linear regression line drawn through a log-log plot of burn rate ($r_b$) versus pressure (P)), higher linear burn rate (i.e., rate of combustion reaction), higher gas yield (moles/mass of generant), higher achieved mass density, higher theoretical density, higher loading density, or combinations thereof as will be discussed in more detail below.

In accordance with the present disclosure, various gas generant compositions exhibit a burn rate that suffers from pressure sensitivity during combustion. Such gas generants comprise a glass fiber particle (e.g., a plurality of glass fiber particles), which desirably lessens (e.g., diminishes, reduces, or minimizes) burn rate pressure sensitivity in comparison to a comparative gas generant composition having the same composition, but lacking the pressure sensitivity reducing glass fiber particles. Exemplary glass fibers suitable for use as pressure sensitivity reducing components in accordance with the present disclosure comprise silicon dioxide, aluminosilicates, borosilicates calcium aluminoborosilicate, or combinations thereof in an amorphous form, although such glass fibers may contain other elements or compounds as are known to those of skill in the art. Particularly suitable pressure sensitivity modifying glass fibers comprise calcium aluminoborosilicate.

Certain calcium aluminoborosilicate-containing glass fibers are known as "E" glass milled fibers. A typical E-glass composition is about 53.5% by weight silicon dioxide ($SiO_2$), about 8% boron oxide ($B_2O_3$), about 14.5% aluminum oxide ($Al_2O_3$), about 21.7% calcium oxide (CaO), and about 1.1% magnesium oxide (MgO). Other commercially available fibers, similar to E fibers are A, B, C, and D type fibers, which typically contain different percentages of the same ingredients, and are contemplated for use as pressure sensitivity modifying components in the present gas generant compositions.

Glass can be manufactured into fibers, including continuous, semi-continuous, or blown fibers. Various methods of forming fibers include spinning, direct melt, or marble melt processes where a molten glass stream is spun or can be passed through an orifice and is cooled to form continuous fibers. Glass fibers for use in accordance with the present disclosure can be formed by using conventional methods and equipment. For example, the glass compositions can be formed into fibers by way of various conventional glass fiber manufacturing processes, such as rotary, CAT, modified rotary processes, flame blown processes, and chopped strand or continuous filament glass fiber processes. Further, glass fibers may be milled in conventional milling equipment. Milled glass fibers are particularly suitable for use in conjunction with the present teachings. By way of example, glass fibers can be hammer-milled to various densities, thus, in certain aspects, the pressure sensitivity modifying glass particle fibers comprise milled glass fibers, such as microglass milled fibers. Thus, such glass fibers are included in a gas generant composition in accordance with the present teachings, and have surprisingly demonstrated superior combustion stability and diminished burn rate pressure sensitivity for materials that suffer from combustion instability reflected in pressure sensitive burn rate profiles.

As used herein, a glass particle fiber has an axial geometry with an aspect ratio (AR) of greater than or equal to about 10:1. Generally, an aspect ratio (AR) for cylindrical shapes (e.g., a rod or fiber) is defined as AR=L/D where L is the length of the longest dimension and D is the diameter of the cylinder or fiber. Exemplary glass fiber particles suitable for use in the present disclosure generally have relatively high aspect ratios, optionally ranging from about 10:1 to about 50:1, and in certain aspects having an aspect ratio of about 10:1 to about 20:1, by way of example. In certain aspects, an average length (i.e., longest dimension) of the glass fiber(s) is greater than or equal to about 3 μm, optionally greater than or equal to about 5 μm, and in certain aspects, optionally greater than or equal to about 10 μm. In certain embodiments, the dimension of the glass fibers used in accordance with the present disclosure range from about 6 to about 13 μm in diameter and about 3 μm to about 24 mm in length. In yet other aspects, the length of the glass fibers is greater than or equal to about 3 μm and less than or equal to about 600 μm. In certain aspects, an average diameter of the glass fibers is greater than or equal to about 10 μm and less than or equal to about 50 μm.

One particularly suitable glass fiber is commercially available as Microglass Milled Fiber 9007D™ from Fibertec Co., which is a microglass milled "E-glass" fiber (CAS No. 65997-17-3) having an average diameter of about 10 μm, a length of about 150 μm (thus having an aspect ration of about 15:1) and an average density after hammermilling of about 0.525 g/cm$^3$.

In accordance with various aspects of the present disclosure, a gas generant composition has a stable combustion profile and reduced burn rate pressure sensitivity. In certain aspects, the gas generant includes a fuel material including at least one nitrogen-containing non-azide fuel and at least one oxidizer, such as basic copper nitrate, along with a plurality of glass fiber particles. In certain embodiments, the gas generant composition optionally includes at least one perchlorate-containing oxidizer, which unexpectedly enhances gas generant dynamic performance and effluent behavior, as will be discussed in greater detail below. Further, in certain aspects, the gas generant is substantially free of polymeric binder.

In certain aspects, the gas generants can be formed in unique shapes that optimize the ballistic burning profiles of the materials contained therein, such as monolithic grains that are substantially free of binders, as disclosed in U.S. Patent Publication No. 2007/0296190 (U.S. Ser. No. 11/472,260) to Hussey et al. entitled "Monolithic Gas Generant Grains," the relevant portions of which are incorporated herein by reference.

In certain aspects, the gas generant is formed from a gas generant powder created by a spray drying process. In certain aspects, an aqueous mixture including a mixture of at least one fuel and at least one oxidizer, optionally including a perchlorate-containing oxidizer, is spray dried to form a powder material. In certain aspects, the aqueous mixture includes various other optional ingredients, as well. In certain embodiments, the aqueous mixture further includes a plurality of glass fiber particles introduced and mixed therein, where the aqueous mixture is spray dried to produce a gas generant powder. The powder is then pressed to produce grains of the gas generant.

In other embodiments, an aqueous mixture includes a mixture containing at least one fuel and at least one oxidizer along with other optional ingredients that are spray dried to form a powder material. Then, the powder material is mixed with a plurality of glass fiber particles and optionally a perchlorate containing oxidizer (e.g., dry blended). The mixture of powder and glass fibers is then pressed to produce grains of the gas generant.

In various embodiments, the gas generant composition comprises at least one fuel. Preferably, the fuel component is a nitrogen-containing compound, but is an azide-free compound. In certain aspects, preferred fuels include tetrazoles and salts thereof (e.g., aminotetrazole, mineral salts of tetrazole), bitetrazoles (e.g., diammonium 5,5'-bitetrazole), 1,2,4-triazole-5-one, guanidine nitrate, nitro guanidine, amino guanidine nitrate and the like. These fuels are generally categorized as gas generant fuels due to their relatively low burn rates, and are often combined with one or more oxidizers in order to obtain desired burn rates and gas production. In certain embodiments, the gas generant comprises at least guanidine nitrate as a fuel component and may optionally comprise other suitable fuels, as well.

In certain embodiments, suitable pyrotechnic materials for the gas generants of the present disclosure comprise a substituted basic metal nitrate. The substituted basic metal nitrate can include a reaction product formed by reacting an acidic organic compound with a basic metal nitrate. Examples of suitable acidic organic compounds include, but are not limited to, tetrazoles, imidazoles, imidazolidinone, triazoles, urazole, uracil, barbituric acid, orotic acid, creatinine, uric acid, hydantoin, pyrazoles, derivatives and mixtures thereof. Examples of such acidic organic compounds include 5-amino tetrazole, bitetrazole dihydrate, and nitroimidazole. Generally, suitable basic metal nitrate compounds include basic metal nitrates, basic transition metal nitrate hydroxy double salts, basic transition metal nitrate layered double hydroxides, and mixtures thereof. Suitable examples of basic metal nitrates include, but are not limited to, basic copper nitrate, basic zinc nitrate, basic cobalt nitrate, basic iron nitrate, basic manganese nitrate and mixtures thereof. Basic copper nitrate has a high oxygen-to-metal ratio and good slag forming capabilities upon burn. By way of example, a suitable gas generant composition optionally includes about 5 to about 60% by weight (wt. %) of guanidine nitrate co-fuel and about 5 to about 95 wt. % substituted basic metal nitrate. However, any suitable fuels known or to be developed in the art that can provide gas generants having the desired burn rates, and gas yields, are contemplated for use in various embodiments of the present disclosure.

As appreciated by those of skill in the art, such fuel components may be combined with additional components in the gas generant, such as co-fuels or oxidizers. For example, in certain embodiments, a gas generant composition comprises a substituted basic metal nitrate fuel, as described above, and a nitrogen-containing co-fuel or oxidizer, like guanidine nitrate. Suitable examples of gas generant compositions having suitable burn rates, density, and gas yield for inclusion in the gas generants of the present disclosure include those described in U.S. Pat. No. 6,958,101 to Mendenhall et al., the relevant portion of which is herein incorporated by reference. The desirability of use of various co-fuels, such as guanidine nitrate, in the gas generant compositions of the present disclosure is generally based on a combination of factors, such as burn rate, cost, stability (e.g., thermal stability), availability and compatibility (e.g., compatibility with other standard or useful pyrotechnic composition components).

Thus, certain suitable oxidizers for the gas generant compositions of the present disclosure include, by way of non-limiting example, alkali metal (e.g., elements of Group 1 of IUPAC Periodic Table, including Li, Na, K, Rb, and/or Cs), alkaline earth metal (e.g., elements of Group 2 of IUPAC Periodic Table, including Be, Ng, Ca, Sr, and/or Ba), and ammonium nitrates, nitrites, and perchlorates; metal oxides (including Cu, Mo, Fe, Bi, La, and the like); basic metal nitrates (e.g., elements of transition metals of Row 4 of IUPAC Periodic Table, including Mn, Fe, Co, Cu, and/or Zn); transition metal complexes of ammonium nitrate (e.g., elements selected from Groups 3-12 of the IUPAC Periodic Table); metal ammine nitrates, metal hydroxides, and combinations thereof. One or more co-fuel/oxidizers are selected along with the fuel component to form a gas generant that upon combustion achieves an effectively high burn rate and gas yield from the fuel. One non-limiting, specific example of a suitable oxidizer includes ammonium dinitramide. The gas generant may include combinations of oxidizers, such that the oxidizers may be nominally considered a primary oxidizer, a second oxidizer, and the like.

In certain variations of the present disclosure, the gas generant composition comprises an oxidizer comprising a perchlorate-containing compound, in other words a compound including a perchlorate group ($ClO_4^-$). Such perchlorate oxidizer compounds are typically water soluble. By way of non-limiting example, alkali, alkaline earth, and ammonium perchlorates are contemplated for use in gas generant compositions. In certain aspects, the perchlorate-containing oxidizer is selected from ammonium perchlorates and alkali metal perchlorates. Thus, particularly suitable perchlorate oxidizer compounds include ammonium perchlorate ($NH_4ClO_4$), sodium perchlorate ($NaClO_4$), potassium perchlorate ($KClO_4$), lithium perchlorate ($LiClO_4$), and combinations thereof. In certain aspects, the oxidizer is selected from oxidizer compounds including potassium nitrate ($KNO_3$), strontium nitrate ($Sr(NO_3)_2$), sodium nitrate ($NaNO_3$), ammonium perchlorate ($NH_4ClO_4$), sodium perchlorate ($NaClO_4$), potassium perchlorate ($KClO_4$), lithium perchlorate ($LiClO_4$), magnesium perchlorate ($Mg(ClO_4)_2$), and combinations thereof.

Oxidizing agents may be respectively present in a gas generant composition in an amount of less than or equal to about 60% by weight of the gas generating composition; optionally less than or equal to about 50% by weight; optionally less than or equal to about 40% by weight; optionally less than or equal to about 30% by weight; optionally less than or equal to about 25% by weight; optionally less than or equal to about 20% by weight; and in certain aspects, less than or equal to about 15% by weight of the gas generant composition. In certain aspects, where an oxidizer is a perchlorate oxidizer, it is present in the gas generant at less than about 25% by weight. By way of example, a perchlorate-containing oxidizer is present in certain embodiments at about 1% to about 20% by weight; optionally about 2 to about 15% by weight; optionally about 3 to about 10% by weight of the gas generant.

In certain embodiments, a gas generant comprises at least one fuel component mixed with a combination of oxidizers, including a primary oxidizer and a secondary oxidizer to form a gas generant composition. In certain variations, a gas generant composition comprises at least one fuel component, such as guanidine nitrate or diammonium 5,5'-bitetrazole (DABT), mixed with a combination of oxidizers, including a primary oxidizer, such as basic copper nitrate or ammonium nitrate, and a secondary oxidizer, such as potassium nitrate, to form a gas generant composition. In yet other aspects, a fuel comprises a gas generant comprising at least one fuel component mixed with a combination of oxidizers, including a primary oxidizer and a secondary oxidizer comprising a perchlorate-containing oxidizer. By way of example, a fuel may include guanidine nitrate, a primary oxidizer comprising basic copper nitrate and a secondary oxidizer comprising potassium perchlorate, to form a gas generant composition.

In accordance with the present teachings the gas generant composition comprises a plurality of pressure sensitivity modifying glass fibers dispersed throughout the fuel mixture of the gas generant. In certain aspects, the plurality of fibers is substantially homogenously mixed and distributed through the gas generant grain. The gas generant composition optionally comprises greater than or equal to about 0 to less than or equal to about 10 wt. % of the glass fibers; optionally greater than or equal to about 1 to less than or equal to about 5 wt. % of the glass fibers; optionally greater than or equal to about 2 to less than or equal to about 4 wt. % of the glass fibers; and in certain aspects, optionally greater than or equal to about 2.5 to less than or equal to about 3 wt. % of the glass fibers.

In certain aspects, a suitable gas generant composition comprises a fuel component present at about 40 to about 60 wt. % of the total gas generant composition; a primary oxidizer present at about 25 to about 60 wt. % of the total gas generant composition; and a secondary oxidizer at about 1 to about 20 wt. % of the total gas generant composition. The gas generant composition further comprises a plurality of pressure sensitivity modifying glass fiber particles present at greater than or equal to about 1% and less than about 10% by wt. of the gas generant composition, in addition to the fuel mixture. In yet other aspects, the gas generant comprises less than or equal to about 5% by weight of respective other ingredients, such as less than or equal to about 5% by weight of a slag promoting agent and less than or equal to about 5% by weight of a lubricating or press release agent.

In certain aspects, a gas generant composition comprises 5-amino tetrazole fuel at about 24 wt. %, ammonium nitrate at about 65 to about 66 wt. %, potassium nitrate at about 6 to about 7 wt. %, and glass fibers at about 3 wt. %. In certain aspects, such glass fibers are milled "E" type glass fibers comprising calcium aluminoborosilicate. In yet another embodiment, a gas generant composition comprises diammonium 5,5'-bitetrazole (DABT) fuel at about 21 to about 22 wt. %, ammonium nitrate at about 67 wt. %, and glass fibers ($SiO_2$) at about 5 wt. %.

Other suitable additives for gas generants include slag forming agents, flow aids, viscosity modifiers, pressing aids, dispersing aids, or phlegmatizing agents that can be included in the gas generant composition. The gas generant compositions optionally include a slag forming agent, such as a refractory compound, e.g., aluminum oxide and/or non-fiber based silicon dioxide, like fumed silicon dioxide. Notably, conventional slag forming silicon dioxide particles and/or powder do not impact combustion stability or provide pressure sensitivity modification, as the glass fibers of the present teachings do, as will be discussed in greater detail below. Other suitable viscosity modifying compounds/slag forming agents include cerium oxide, ferric oxide, zinc oxide, titanium oxide, zirconium oxide, bismuth oxide, molybdenum oxide, lanthanum oxide and the like. Generally, such slag forming agents may be included in the gas generant composition in an amount of 0 to about 10 wt. %, optionally at about 0.5 to about 5 wt. % of the gas generant composition.

Coolants for lowering gas temperature, such as basic copper carbonate or other suitable carbonates, may be added to the gas generant composition at 0 to about 20% by wt. Similarly, press aids for use during compression processing, include lubricants and/or release agents, such as graphite, calcium stearate, magnesium stearate, molybdenum disulfide, tungsten disulfide, graphitic boron nitride, by way of non-limiting example, may also be added prior to tableting or pressing and can be present in the gas generant at 0 to about 2%. While in certain aspects it is preferred that the gas generant compositions are substantially free of polymeric binders, in certain alternate aspects, the gas generant compositions optionally comprise low levels of certain acceptable binders or excipients to improve crush strength, while not significantly harming effluent and burning characteristics. Such excipients include microcrystalline cellulose, starch, carboxyalkyl cellulose, e.g., carboxymethyl cellulose (CMC), by way of example. When present, such excipients can be included in gas generant compositions at less than 10 wt. %, optionally less than about 5 wt. %, and optionally less than or equal to about 2.5 wt. %.

Additionally, other ingredients can be added to modify the burn profile of the pyrotechnic fuel material by modifying pressure sensitivity of the burning rate slope, in addition to the glass fibers. Thus, a gas generant may include a plurality of pressure sensitivity modifying agents, including the glass fiber and another distinct pressure sensitivity modifying agent. One such example is copper bis-4-nitroimidazole, which is described, along with other similar additives in more detail in U.S. Publication No. 2007/0240797 (U.S. patent application Ser. No. 11/385,376) entitled "Gas Generation with Copper Complexed Imidazole and Derivatives" to Mendenhall et al., the disclosure of which is herein incorporated by reference in its entirety. A total amount of pressure sensitivity modifying agents, including the plurality of glass fibers, can be present in the present gas generant compositions at greater than 0 to about 10 wt. %. Other additives known or to be developed in the art for pyrotechnic gas generant compositions are likewise contemplated for use in various embodiments of the present disclosure, so long as they do not unduly detract from the desirable burn profile characteristics of the gas generant compositions.

In certain aspects, the gas generant may include about 30 to about 70 parts by weight, more preferably about 40 to about 60 parts by weight, of at least one fuel (e.g., guanidine nitrate), about 25 to about 80 parts by weight of oxidizers (e.g., primary and secondary oxidizers, such as basic copper nitrate and potassium perchlorate), from greater than 0 to about 10 parts by weight of pressure sensitivity modifying agents, including glass fibers comprising at least one compound selected from the group consisting of silicon dioxide, aluminosilicate, borosilicate, calcium aluminoborosilicate; and combinations thereof; and optionally about 0 to about 5 parts by weight of slag forming agents like fumed silica ($SiO_2$) or equivalents thereof; and 0 to about 1 part by weight of press aids or release aids or lubricants.

Significant improvements in gas generant performance, including higher combustion stability are achieved in accordance with the present teachings when pressure sensitivity modifying glass fiber agents, are included in the gas generant compositions. Further, such glass fibers may be introduced to the gas generant prior to or during spray drying, or in alternate aspects, after the gas generant powder has been formed via dry blending or mixing.

The gas-generating composition may be formed from an aqueous dispersion of one or more fuel components that are added to an aqueous vehicle to be substantially dissolved or suspended. The oxidizer components are dispersed and stabilized in the fuel solution either dissolved in the solution or optionally present as a stable dispersion of solid particles. The solution or dispersion may also be in the form of a slurry. The aqueous dispersion or slurry is spray-dried by passing the mixture through a spray nozzle in order to form a stream of droplets. The droplets contact hot air to effectively remove water and any other solvents from the droplets and subsequently produce solid particles of the gas generant composition, as will be described in greater detail below.

The mixture of components forming the aqueous dispersion may also take the form of a slurry, where the slurry is a flowable or pumpable mixture of fine (relatively small particle size) and substantially insoluble particle solids suspended in a liquid vehicle or carrier. Mixtures of solid materials, like the pressure sensitivity modifying glass fibers, suspended in a carrier are also contemplated. In some embodiments, the slurry comprises particles or glass fibers having an average maximum particle size of less than about 500 μm, optionally less than or equal to about 200 μm, and in some cases, less than or equal to about 100 μm as discussed previously above. In certain embodiments, where a perchlorate-containing oxidizer is selected as an oxidizer, it has an average particle size of less or equal to about 200 μm, optionally less than or equal to about 150 μm, and in certain aspects, less than or equal to about 100 μm. In circumstances where the particle size of the perchlorate in the gas generant composition is important to performance of the gas generant, it can be dry blended after the spray dry process at the desired particle size, since most perchlorates have some water solubility. Thus, the slurry contains flowable and/or pumpable suspended solids and other materials in a carrier.

Suitable carriers include aqueous solutions that may be mostly water; however, the carrier may also contain one or more organic solvents or alcohols. In some embodiments, the carrier may include an azeotrope, which refers to a mixture of two or more liquids, such as water and certain alcohols that desirably evaporate in constant stoichiometric proportion at specific temperatures and pressures. The carrier should be selected for compatibility with the fuel and oxidizer components to avoid adverse reactions and further to maximize solubility of the several components forming the slurry. Non-limiting examples of suitable carriers include water, isopropyl alcohol, n-propyl alcohol, and combinations thereof.

Viscosity of the slurry is such that it can be injected or pumped during the spray drying process. In some embodiments, the viscosity is kept relatively high to minimize water and/or solvent content, for example, so less energy is required for carrier removal during spray drying. However, the viscosity may be lowered to facilitate increased pumping rates for higher pressure spray drying. Such adjustments may be made when selecting and tailoring atomization and the desired spray drying droplet and particle size.

In some embodiments, the slurry has a water content of greater than or equal to about 15% by weight and may be greater than or equal to about 20 wt. %, optionally about 30 wt. %, or optionally about 40 wt. %. In some embodiments, the water content of the slurry ranges from about 15% to 85% by weight. As the water content increases, the viscosity of the slurry decreases, thus pumping and handling become easier. In some embodiments, the slurry has a viscosity ranging from about 50,000 to 250,000 centipoise. Such viscosities are believed to be desirable to provide suitable rheological properties that allow the slurry to flow under applied pressure, but also permit the slurry to remain stable.

In certain embodiments, a plurality of pressure sensitivity modifying agents, including glass fibers are mixed in the aqueous gas generant dispersion, in accordance with the present teachings. Further, in some embodiments, a quantity of non-fibrous silica ($SiO_2$), like fumed silica particles, is included in the aqueous dispersion, which can act as a slag forming oxidizer component, but can also serve to thicken the dispersion and reduce or prevent migration of solid oxidizer particles and glass fibers in the bulk dispersion and droplets. The non-fibrous silica can also react with the oxidizer during the redox reaction to form a glassy slag that is easily filtered out of the gas produced upon ignition of the gas generant. The non-fibrous silica is preferably in very fine particulate form. In certain embodiments, preferable grades of non-fibrous silica include those having average particle sizes of about 7 nm to about 20 nm, although in certain aspects, silica having average particles sizes of less than or equal to about 50 μm may be employed as well.

In certain aspects when forming the aqueous dispersion, the composition is mixed with sufficient aqueous solution to dissolve substantially the entire fuel component at the spray temperature; however, in certain aspects, it is desirable to restrict the amount of water to a convenient minimum in order to minimize the amount of water that is to be evaporated in the spray-drying process. For example, the dispersion may have less than or equal to about 100 parts by weight of water for about 30 to about 45 parts by weight of fuel component.

The oxidizer components may be uniformly dispersed in the fuel solution by vigorous agitation to form the dispersion, where the particles of oxidizer are separated to a sufficient degree to form a stable dispersion. In the case of water insoluble oxidizers, the viscosity will reach a minimum upon achieving a fully or near fully dispersed state. In certain aspects, the oxidizers, like perchlorates, have an average particle size of less than or equal to about 200 μm. In certain embodiments, pressure sensitivity modifying agent glass fibers are also uniformly mixed in the dispersion. A high shear mixer may be used to achieve efficient dispersion of the oxidizer particles and optional pressure sensitivity modifying agent glass fibers. The viscosity of the dispersion should be sufficiently high to prevent any substantial migration (i.e., fall-out or settling) of the solid particles and fibers in the mixture.

The spray drying process is used for forming particles and drying materials. It is suited to continuous production of dry solids in powder, granulate, or agglomerate particle forms using liquid feedstocks of the redox couple components to make the gas generant. Spray drying can be applied to liquid solutions, dispersions, emulsions, slurries, and pumpable suspensions. Variations in spray drying parameters may be used to tailor the dried end-product to precise quality standards and physical characteristics. These standards and characteristics include particle size distribution, residual moisture content, bulk density, and particle morphology.

Spray drying includes atomization of the aqueous mixture, for example, atomization of the liquid dispersion of redox couple components into a spray of droplets. The droplets are then contacted with hot air in a drying chamber. Evaporation of moisture from the droplets and formation of dry particles proceeds under controlled temperature and airflow conditions. Powder may be continuously discharged from the drying chamber and recovered from the exhaust gases using, for example, a cyclone or a bag filter. The whole process may take no more than a few seconds. In some embodiments, the liquid dispersion or slurry is heated prior to atomization.

A spray dryer apparatus typically includes a feed pump for the liquid dispersion, an atomizer, an air heater, an air disperser, a drying chamber, and a system for powder recovery, an exhaust air cleaning system, and a process control system. Equipment, process characteristics, and quality requirements may be adjusted based on individual specifications. Atomization includes forming sprays having a desired droplet size distribution so that resultant powder specifications may be met. Atomizers may employ various approaches to droplet formation and include rotary (wheel) atomizers and various types of spray nozzles. For example, rotary nozzles provide atomization using centrifugal energy, pressure nozzles provide atomization using pressure energy, and two-fluid nozzles provide atomization using kinetic energy. Airflow adjustment and configuration (co-current, counter-current, and/or mixed flow) may be used to control the initial contact between spray droplets and the drying air in order to control evaporation rate and product temperature in the dryer.

The aqueous dispersion of gas generant components may be atomized using a spray nozzle to form droplets of about 40 μm to about 200 μm in diameter by forcing the droplets under pressure through a nozzle having one or more orifices of about 0.5 mm to 2.5 mm in diameter. The droplets may be spray-dried by allowing the droplets to fall into or otherwise contact a stream of hot air at a temperature in the range from about 80° C. to about 250° C., preferably about 80° C. to about 180° C. The outlet and inlet temperatures of the air stream may be different in order to achieve the heat transfer required for drying the droplets. The preceding illustrative air temperature ranges are further indicative of examples of outlet and inlet temperatures, respectively.

Particles produced from the spray-dried droplets may comprise aggregates of very fine mixed crystals of the gas generant components, having a primary crystal size of about 0.5 μm to about 5 μm in the thinnest dimension, and preferably about 0.5 μm to about 1 μm. However, in certain embodiments, water insoluble oxidizer components can be obtained in very small particle sizes and incorporated in the aqueous solution of dissolved fuel component to form a dispersion, thereby reducing the water content required for the aqueous medium. Furthermore, the plurality of glass fiber serve as nucleation sites, for example, forming prills (aggregates) in the spray drying process (e.g., in the spray drier).

Thus, the dried particles of gas generant may take the form of substantially cylindrical microporous aggregates of fuel crystals (e.g., guanidine nitrate crystals) having a narrow size distribution within the range required for substantially complete reaction with the oxidizers. For example, the spherical microporous aggregates may be about 20 μm to about 100 μm in diameter, the primary fuel crystals being about 0.5 μm to about 5 μm and generally about 0.5 μm to 1 about μm in the thinnest dimension. Generally, particles of the solid oxidizer(s) and/or glass fibers are encapsulated by the fuel crystals, where the oxidizer particles and/or glass fibers serve as crystal growth sites for the fuel component crystals. The spray drying process produces very little ultrafine dust that could be hazardous in subsequent processing operations.

Figure 3:
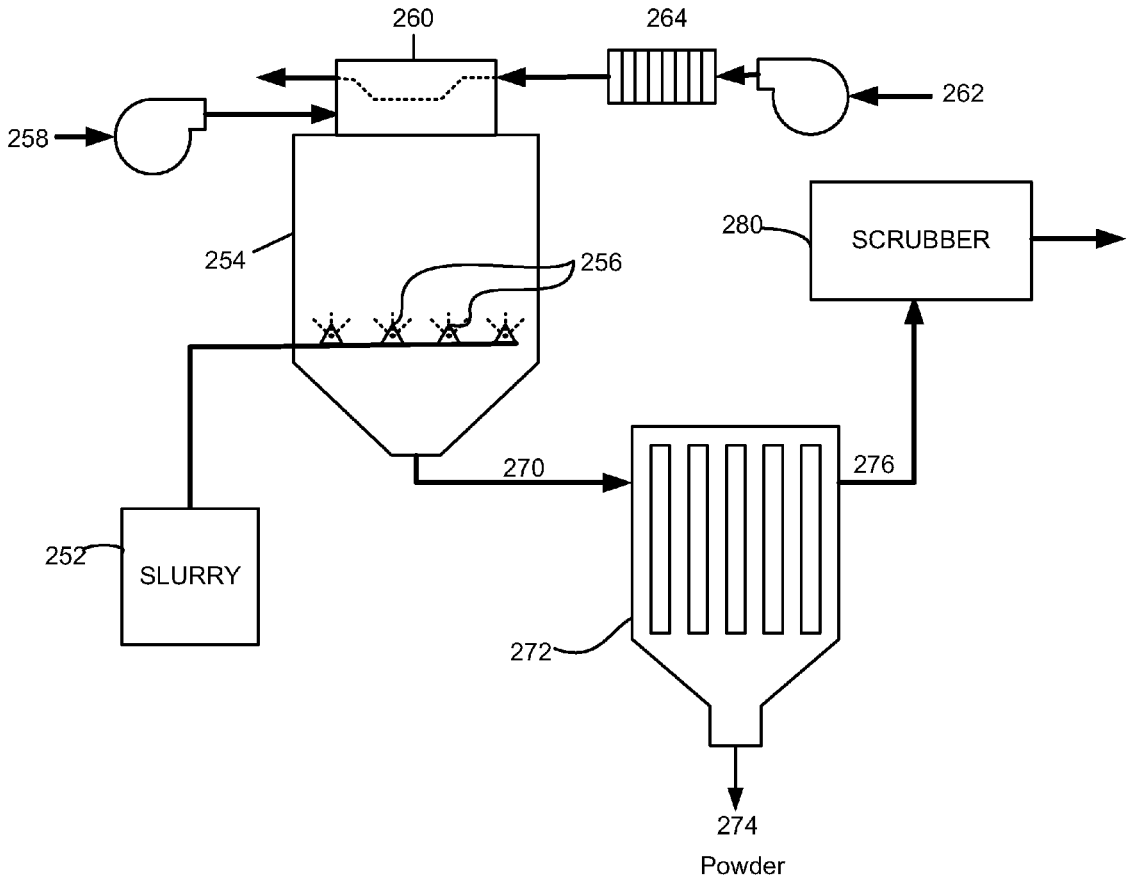
FIG. 3 is a simplified schematic of an exemplary spray drying process.

Spray drying a mixture of fuel (for example, guanidine nitrate) and a primary oxidizer (for example, basic copper nitrate), and secondary oxidizer (for example, potassium perchlorate), along with an optional plurality of glass fibers, may be accomplished using various spray drying techniques and equipment. An exemplary simplified spray drying system is shown in FIG. 3. A slurry source 252 contains a slurry comprising the individual components of the gas generant, which is fed to a mixing chamber 254. The slurry is forced through one or more atomizing nozzles 256 at high velocity against a counter current stream of heated air. The slurry is thus atomized and the water removed. The heated air is generated by feeding an air source 258 to a heat exchanger 260, which also receives a heat transfer stream 262. The heat transfer stream 262 may pass through one or more heaters 264. The atomization of slurry in the mixing chamber 254 produces a rapidly dried powder that is entrained in an effluent stream 270. The effluent stream 270 can be passed through a collector unit 272, such as a baghouse or electrostatic precipitator, which separates powder/particulates from gas. The powder 274 is recovered from the collector unit 272 and can then be pelletized, compacted, or otherwise fashioned into a shape suitable for use as a gas generant in an inflating device. The exhaust stream 276 from the separator unit 272 can optionally be passed through one or more processes downstream as necessary, such as a scrubber system 280.

The present methods may employ various spray driers as known in the art. For example, suitable spray drying apparatuses and accessory equipment include those manufactured by Anhydro Inc. (Olympia Fields, Ill.), BUCHI Corporation (New Castle, Del.), Marriott Walker Corporation (Birmingham, Mich.), Niro Inc. (Columbia, Md.), and Spray Drying Systems, Inc. (Eldersburg, Md.).

In certain aspects, a suitable spray drying process to form powdered or particulate materials includes those processes described in U.S. Pat. No. 5,756,930 to Chan et al, the relevant portions of which are incorporated herein by reference, which describes two-fluid nozzle spray drying techniques. Products produced by a single orifice fountain nozzle generally have a substantially larger particle size than that produced from the two-fluid nozzle and is particularly suitable for tableting (i.e., pressing or compacting under pressure) without requiring further processing. In certain aspects, this is advantageous compared to powder produced with the two-fluid nozzle, which generally requires further roll compacting and regrinding after spray drying in order to produce a material which can then be tableted. While either the two-fluid nozzle spray drying and single orifice fountain nozzle are suitable for use in accordance with the present disclosure, in certain aspects, gas generant grains made by pressing material produced with the single orifice fountain nozzle spray dry process are particularly suitable, in that they are generally superior in compaction, density, and homogeneity.

In various aspects, the present methods may be used to produce a high burning rate gas generant composition, including at least one fuel and at least one oxidizer. For example, a suitable non-limiting gas generant composition includes a fuel selected from guanidine nitrate. 5-aminotetrazole and/or diammonium 5,5'-bitetrazole (DABT), a primary oxidizer selected from basic copper nitrate, ammonium nitrate, and/or potassium nitrate, and a secondary perchlorate-containing oxidizer, such as potassium perchlorate and/or ammonium perchlorate. The gas composition includes glass fibers, for example from about 1 to about 10 wt. %. The gas generant composition may also include up to about 5% by weight of a slag promoter, such as non-fibrous silicon dioxide. The process includes forming an aqueous mixture of the components by first completely dissolving the guanidine nitrate and then adding the basic copper nitrate and potassium perchlorate to the aqueous mixture to produce a slurry. As noted previously, the glass fibers may optionally be mixed in the aqueous mixture and spray dried with the fuel mixture or can be dry blended after the gas generant powder is formed. The slurry is spray dried with a single orifice fountain nozzle to produce a freely flowing powder. The resulting powder is pressed into tablets, cylinders, or other geometries to produce grains suitable for use as a gas generant in an inflatable restraint system. Resulting tablets and pellets produced using material from single orifice fountain nozzle generally have fewer physical defects, such as voids and chips of the gas generant grain or pellet, as compared to tablets and pellets produced using material from two-fluid nozzle.

In this regard, certain gas generant materials can be formed into a compressed monolithic grain shape, as discussed previously above, which can have an actual density that is greater than or equal to about 90% of the maximum theoretical density. According to certain aspects of the present disclosure, the actual density is greater than or equal to about 93%, more preferably greater than about 95% of the maximum theoretical density, and even more preferably greater than about 97% of the maximum theoretical density. In some embodiments, the actual density exceeds about 98% of the maximum theoretical density of the gas generant material. Such high actual mass densities in gas generant materials are obtained in certain methods of forming gas generant grains in accordance with spray drying techniques described above, where high compressive force is applied to gas generant raw materials that are substantially free of binder.

In accordance with the present disclosure, the gas generant materials are in a dry powderized and/or pulverized form. The dry powders are compressed with applied forces greater than about 50,000 psi (approximately 350 MPa), preferably greater than about 60,000 psi (approximately 400 MPa), more preferably greater than about 65,000 psi (approximately 450 MPa), and most preferably greater than about 74,000 psi (approximately 500 MPa). The powderized materials can be placed in a die or mold, where the applied force compresses the materials to form a desired grain or tablet shape.

Further, it is preferred that a loading density of the gas generant is relatively high; otherwise a low performance for a given envelope may result. A loading density is an actual volume of generant material divided by the total volume available for the shape. In accordance with various aspects of the present disclosure, it is preferred that a loading density for the gas generant shape is greater than or equal to about 60%, even more preferably greater than or equal to about 62%. In certain aspects, a gas generant has loading density of about 62 to about 63%.

As noted above, in certain aspects, the pressure sensitivity modifying agent glass fibers can be added to the gas generant powders after the powder is formed, for example, by spray drying. The plurality of glass fibers may be dry blended or mixed with the powder prior to pressing or compaction. The dried particles or powder may be readily pressed into pellets or grains for use in a gas-generating charge in inflatable restraints; e.g., air-bags. The pressing operation may be facilitated by mixing the spray-dried gas generant particles with a quantity of water or other pressing aid, such as graphite powder, calcium stearate, magnesium stearate and/or graphitic boron nitride, by way of non-limiting example. The water may be provided in the form of a mixture of water and hydrophobic fumed silicon, which may be mixed with the particles using a high shear mixer. The composition may then be pressed into various forms, such as pellets or grains. In certain embodiments, suitable gas generant grain densities are greater than or equal to about 1.8 g/cm$^3$ and less than or equal to about 2.2 g/cm$^3$.

In some embodiments, methods of making a gas generant use a processing vessel, such as a mix tank, in order to prepare the gas generant formulation that is subsequently processed by spray drying. For example, the processing vessel may be charged with water, guanidine nitrate, and oxidizers including basic copper nitrate and potassium perchlorate, which are mixed to form an aqueous dispersion. The temperature of the slurry may be equilibrated at about 80° C. to about 90° C. for approximately one hour. Additives and components, such as additional fuel components, oxidizer components, glass fibers, slagging aids, and the like may be added to the reaction mixture at this time. The resulting aqueous dispersion is then pumped to the spray drier to form the dry powder or particulate gas generant product. Further processing steps such as blending, pressing, igniter coating, and the like can then be preformed per standard procedures.

EXAMPLE 1

Example 1 and Comparative Examples A and B are gas generants formed by mixing the constituents indicated in Table 1 below at the indicated amounts. The gas generants are formed by blending the appropriate amount of each ingredient in approximately 50% by weight hot water to form a slurry of approximately 20 grams of material based on dry weight. The slurry is then dried at approximately 80° C. with stirring to produce a granular powder. The dried granular powder is then pressed into several pellets each 0.5 inches in diameter and approximately 0.5 inches in length. The pellets are then ignited in a pressurized, closed vessel and the time of burning from one end measured. This process is repeated at multiple pressures to produce data of burning rate versus pressure.

The generant mixtures for each of Comparative Examples A, B and Example 1 are similar to one another, respectively containing a 5-amino tetrazole fuel, and a primary oxidizer of ammonium nitrate and a secondary oxidizer of potassium nitrate. Comparative Example A contains 5 wt. % of untreated amorphous fumed silica particles commercially available from Cabot Corp. as CAB-O-SIL® M-7D, having an average surface area of 200 m$^2$/g and a bulk density of 125 g/l. Comparative Example B contains 3 wt. % of ground crystalline silica particles commercially available from U.S. Silica Comp. as MIN-U-SIL® 40 having a size distribution of 98% of particles less than about 40 μm and an uncompacted bulk density of about 800 g/l.

Example 1 contains about 5 wt. % of milled glass fibers, commercially available from Fibertec Co. as Fibertec 9007D. Example 1 and Comparative Examples A and B are tested for density and to characterize combustion data of each respective gas generant, including burn rates at 1,000 pounds per square inch (about 6.9 MPa) and 3,000 psi (about 20.7 MPa). The burn rate profile is also characterized to find the burn rate constant and slope of burn rate $$r_b = k(P)^n \quad \text{(EQN. 1)}$$

where $r_b$=burn rate (linear); k=is a constant and P=pressure and n=a pressure exponent, where the pressure exponent is the slope of a linear regression line drawn through a log-log plot of burn rate ($r_b$) versus pressure (P). As can be seen from the combustion data, while the burn rates at 1,000 and 3,000 psi, respectively, are higher for Example 1 as compared to Comparative Examples A and B, the "n" pressure exponent (slope of a log-log plot of burn rate ($r_b$) versus pressure (P)) is significantly lower (0.55 versus 0.75 and 0.71, respectively). Moreover, the burn rate constant (k) is desirably higher for Example 1 (0.009) than Comparative Example A (0.002) and Example B (0.002). The lower pressure exponent and increased burn rate constant demonstrate improved combustion stability and reduced pressure sensitivity for similar fuel mixtures, by introducing the pressure sensitivity modifying glass fibers to the gas generant.

TABLE 1

| | Comparative Example (A) Wt. % | Comparative Example (B) Wt. % | Example (1) Wt. % |
|---|---|---|---|
| Composition | | | |
| 5-amino tetrazole | 23.6 | 24.1 | 24.1 |
| Ammonium Nitrate | 65 | 66.4 | 66.4 |
| | Fumed silica | Ground silica particles | Silica glass fibers |
| $SiO_2$ | 5 | 3 | 3 |
| $KNO_3$ | 6.5 | 6.5 | 6.5 |
| Density g/cc | 1.73 | 1.73 | 1.68 |
| Combustion Data | | | |
| $R_b$@1000 psi (inches per second) | 0.26 | 0.31 | 0.39 |
| $R_b$@3000 psi (ips) | 0.59 | 0.68 | 0.72 |
| Slope (n) | 0.75 | 0.71 | 0.55 |
| Constant (k) | 0.002 | 0.002 | 0.009 |

EXAMPLE 2

Example 2 and Comparative Examples C and D are gas generants formed by mixing the compounds indicated in Table 2 below at the indicated amounts, formed and tested in the same manner as described in Example 1. The fuel mixtures for each of Comparative Examples C-D and Example 2 are similar to one another, containing a diammonium 5,5'-bitetrazole (DABT) fuel and a primary oxidizer of ammonium nitrate and a secondary oxidizer of potassium nitrate. Comparative Example C contains 5 wt. % of fumed silica particles CAB-O-SIL® M-7D and Comparative Example D contains 5 wt. % of ground silica particles MIN-U-SIL® 40. Example 2 contains about 5 wt. % of milled glass fibers, commercially available as Fibertec 9007D. Example 2 and Comparative Examples C and D are tested for density and to characterize combustion data of each respective gas generant, including burn rates at 1,000 pounds per square inch (about 6.9 MPa) and 3,000 psi (about 20.7 MPa).

As can be seen from the combustion data, while the burn rates at 1,000 and 3,000 psi are higher for Example 2 (0.34 at 1,000 psi and 0.67 at 3,000 psi) as compared to Comparative Examples C (0.17 at 1,000 psi and 0.39 at 3,000 psi) and D (0.17 at 1,000 psi and 0.47 at 3,000 psi), the "n" pressure exponent (slope of a log-log plot of burn rate ($r_b$) versus pressure (P)) is significantly lower (0.62 versus 0.73 and 0.92, respectively). Moreover, the burn rate constant (k) is desirably higher for Example 2 (0.005) than Comparative Example C (0.001) and Example D (0.003). The significantly lower pressure exponent and increased burn rate constant demonstrate improved combustion stability and reduced pressure sensitivity for similar fuel mixtures by introduction of the glass fibers to the gas generant.

TABLE 2

| | Comparative Example (C) Wt. % | Comparative Example (D) Wt. % | Example (2) Wt. % |
|---|---|---|---|
| Composition | | | |
| Diammonium 5,5'-bitetrazole (DABT) | 21.5 | 21.5 | 21.5 |
| Ammonium Nitrate | 66.8 | 66.8 | 66.8 |
| | Fumed silica | Ground silica particles | Silica glass fibers |
| $SiO_2$ | 5 | 5 | 5 |
| $KNO_3$ | 6.7 | 6.7 | 6.7 |
| Density g/cc | 1.69 | 1.7 | 1.69 |
| Combustion Data | | | |
| $R_b$@1000 psi (ips) | 0.17 | 0.17 | 0.34 |
| $R_b$@3000 psi (ips) | 0.39 | 0.47 | 0.67 |
| Slope (n) | 0.73 | 0.92 | 0.62 |
| Constant (k) | 0.001 | 0.003 | 0.005 |

EXAMPLE 3

The gas generant of Example 3 is formed by mixing the compounds indicated in Table 3 below at the indicated amounts, which is pressed into a tablet having a dimension of 0.25 inches by 0.080 inches and assembled into a standard inflator. Comparative Example E gas generant is also pressed into a tablet (0.25 by 0.080 inches) in the same manner as Example 3 and assembled in the same type of standard inflator.

TABLE 3

| Composition | Example (3) Wt. % | Comparative Example (E) Wt. % |
|---|---|---|
| Guanidine Nitrate | 50.34 | 51.85 |
| Basic Copper Nitrate | 41.92 | 43.18 |
| Ammonium perchlorate | 1.9 | 1.96 |
| Calcium Stearate | 0.13 | 0.13 |
| Fumed $SiO_2$ | 0.29 | 0.3 |
| Aluminum Oxide | 2.57 | 2.65 |
| Glass Fiber $SiO_2$ | 2.85 | — |

Figure 2:
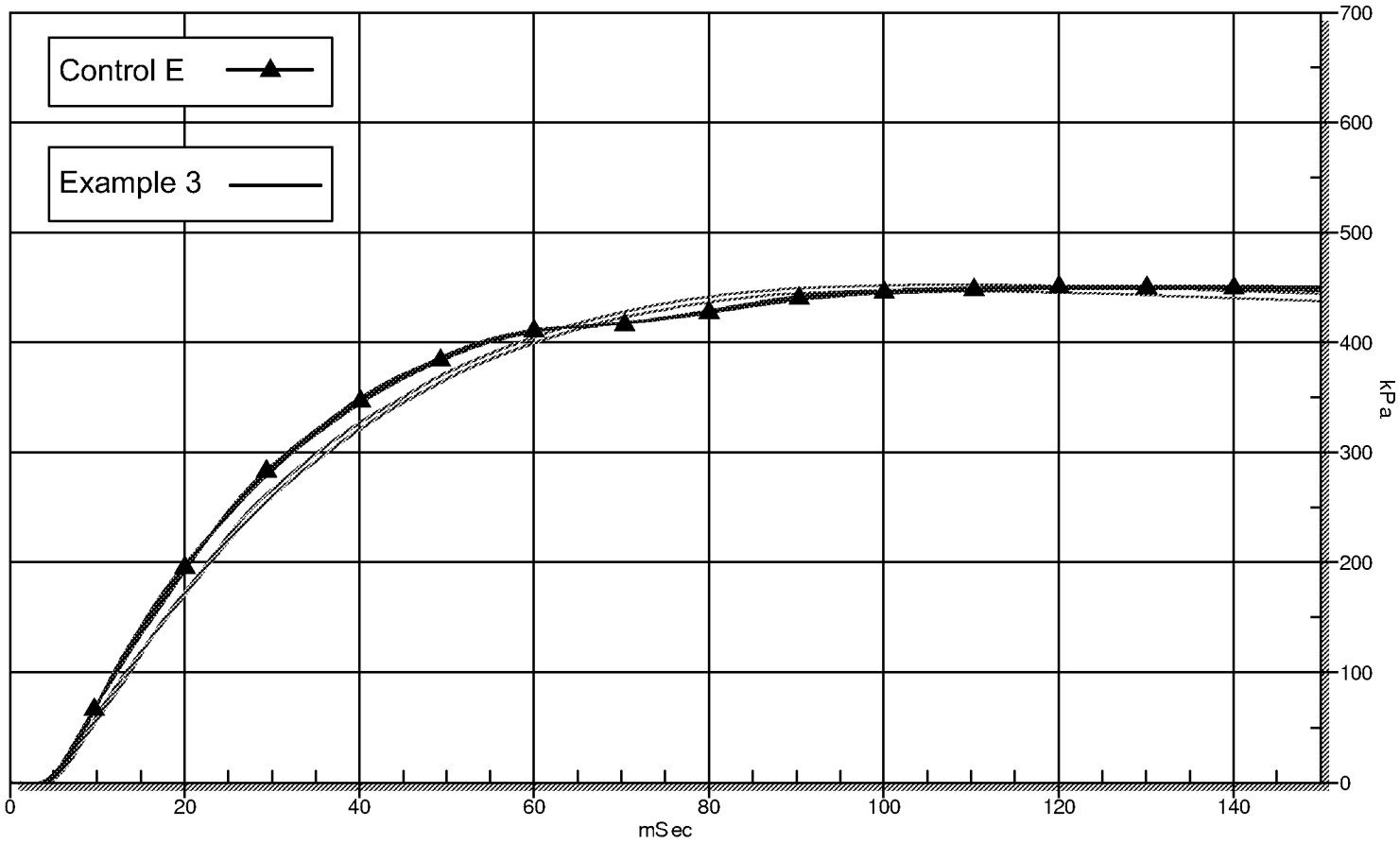
FIG. 2 reflects comparative gas generant performance of an inflator (time versus pressure) of a conventional prior art gas generant composition exhibiting pressure sensitivity during combustion and combustion performance of a gas generant material prepared in accordance with the present teachings having pressure sensitivity modifying glass fiber particles.

The inflators are deployed and performance, gas effluents, and particulate output are measured. FIG. 2 shows the gas generant performance of Example 3 and Comparative Example E during burning. The combustion stability of Example 3 is improved, as can be observed based on the smooth pressure versus time curve obtain in a 60-liter inflator tank. When Comparative Example E (lacking any glass fibers, but having fumed silica, like in Example 3) is deployed in a 60-liter tank inflator, the combustion curve shows a pronounced dip between about 60 and 100 milliseconds, which indicates undesirable pressure sensitivity. Not only does Example 3 demonstrate reduced pressure sensitivity during the 60 to 100 millisecond interval (where the curve is significantly smoother), but also, the gas effluent and particulate output is improved, as shown in Table 4 below.

Table 4 compares effluent generated from the tablet of Example 3 having pressure sensitivity modifying glass fibers with a conventional gas generant tablet of Comparative Example E, having the same gas generant composition, but lacking the glass fibers. The U.S. Council for Automotive Research (USCAR) issues guidelines for maximum recommended levels of effluent constituents in airbag devices. Desirably, the production of these effluents is minimized to at or below these guidelines. Certain current USCAR guidelines for a driver-side inflatable restraint device are included in Table 4.

Tests are performed for 30 minutes to develop a time weighted average (TWA) showing an average effluent analysis during combustion of the gas generant by Fourier Transform Infrared Analysis (FTIR) showing that the nitrogen oxide species, including NO and $NO_2$, as well as ammonium, airborne particulates, and the like are improved when the pressure sensitivity modifying glass fibers are included in the gas generant (Example 3). As can be observed, carbon monoxide, ammonia, NO and $NO_2$, airborne particulate, and average ambient part weight trace gas levels (effluent levels) are below the USCAR standards. The average hot effluent is data from an inflator firing at 80° C. The amount of particulate escaping the inflator is typically greater at hot conditions, so this generally predicts effluent production (which has a reduced magnitude) expected at lower heat at ambient conditions.

TABLE 4

| EFFLUENT SPECIES | EXAMPLE (3) Average (ppm) | COMPARATIVE EXAMPLE (E) Average (ppm) | USCAR Guideline Vehicle Limit (ppm) |
|---|---|---|---|
| Carbon Monoxide | 248 | 273 | 461 |
| Nitric Oxide | 51 | 67 | 75 |
| Nitrogen Dioxide | <1 | 6 | 5 |

TABLE 4-continued

| EFFLUENT SPECIES | EXAMPLE (3) Average (ppm) | COMPARATIVE EXAMPLE (E) Average (ppm) | USCAR Guideline Vehicle Limit (ppm) |
|---|---|---|---|
| Ammonia | 2 | 4 | 35 |
| Airborne Particulate | 23 | 27 | — |
| Part Weight - Average Hot | 544 | 883 | — |

EXAMPLE 4

The gas generant of Examples 4-6 and Comparative Example F are formed by mixing the compounds indicated in Table 5 below.

TABLE 5

| Composition | Example (4) Wt. % | Example (5) Wt. % | Example (6) Wt. % | Comparative Example (F) Baseline Wt. % |
|---|---|---|---|---|
| Guanidine Nitrate | 52.21 | 51.22 | 50.26 | 52.72 |
| Basic Copper Nitrate | 41.84 | 41.04 | 40.27 | 42.25 |
| Ammonium perchlorate | 1.94 | 1.9 | 1.87 | 1.96 |
| Calcium Stearate | 0.14 | 0.13 | 0.13 | 0.14 |
| Fumed $SiO_2$ | 0.29 | 0.29 | 0.28 | 0.29 |
| Glass Fiber $SiO_2$ | 0.97 | 2.85 | 4.67 | — |
| **Combustion Data** | | | | **Baseline Slope (n')** |
| Slope ($n_1$) - initial | 0.5686 | 0.507 | 0.4631 | 0.6344 |
| % Change from Baseline Slope ($n_1$') | 10% | 20% | 27% | |
| Slope ($n_2$) - secondary | 0.3856 | 0.3893 | 0.3882 | 0.4062 |
| % Change from Baseline Slope ($n_2$') | 5% | 4% | 4% | |

Figure 4:
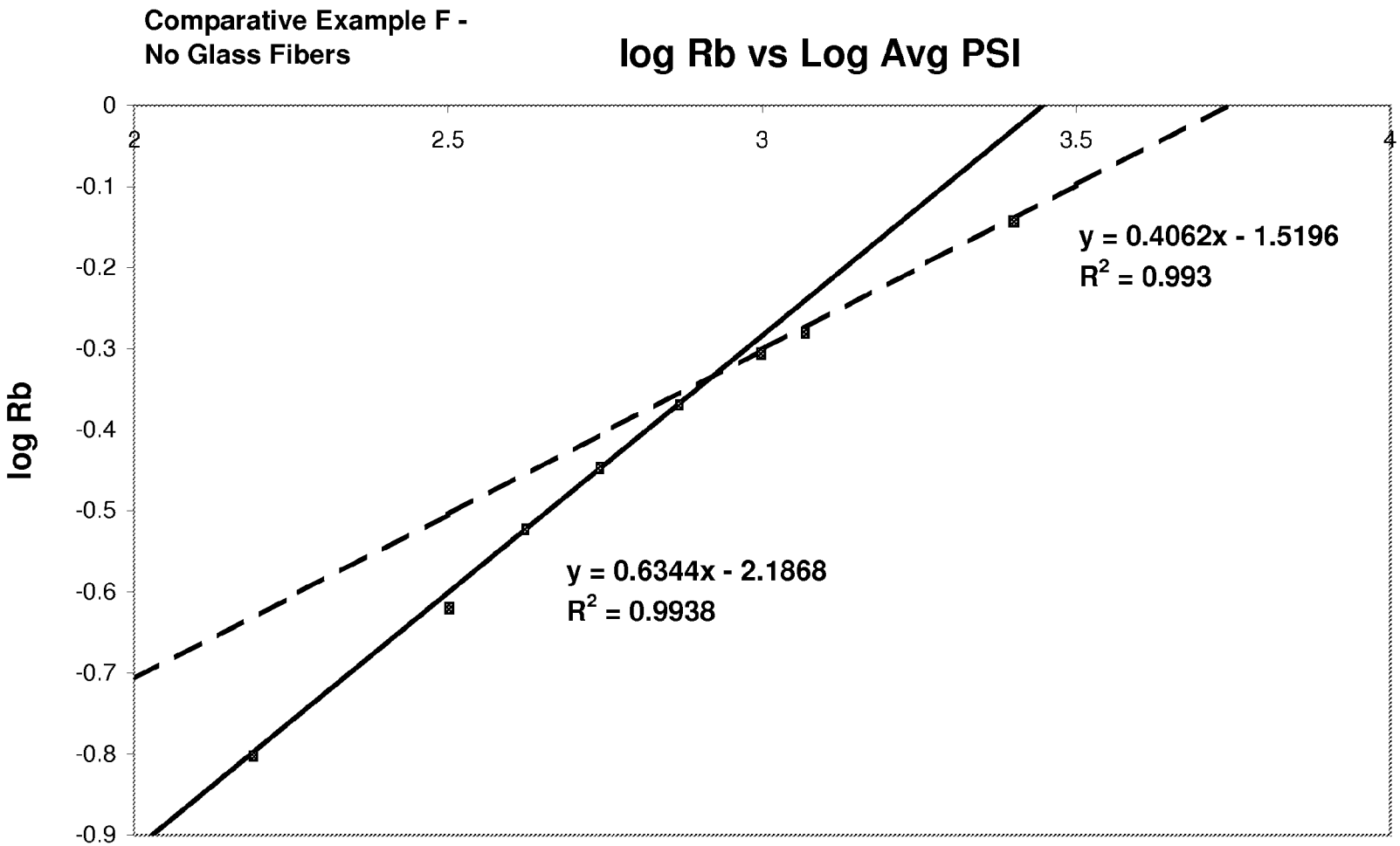
FIG. 4 is a combustion profile (logarithm of burn rate ($r_b$) versus a logarithm of pressure (P)) for a gas generant material lacking pressure sensitivity modifying glass fiber particles.
Figure 5:
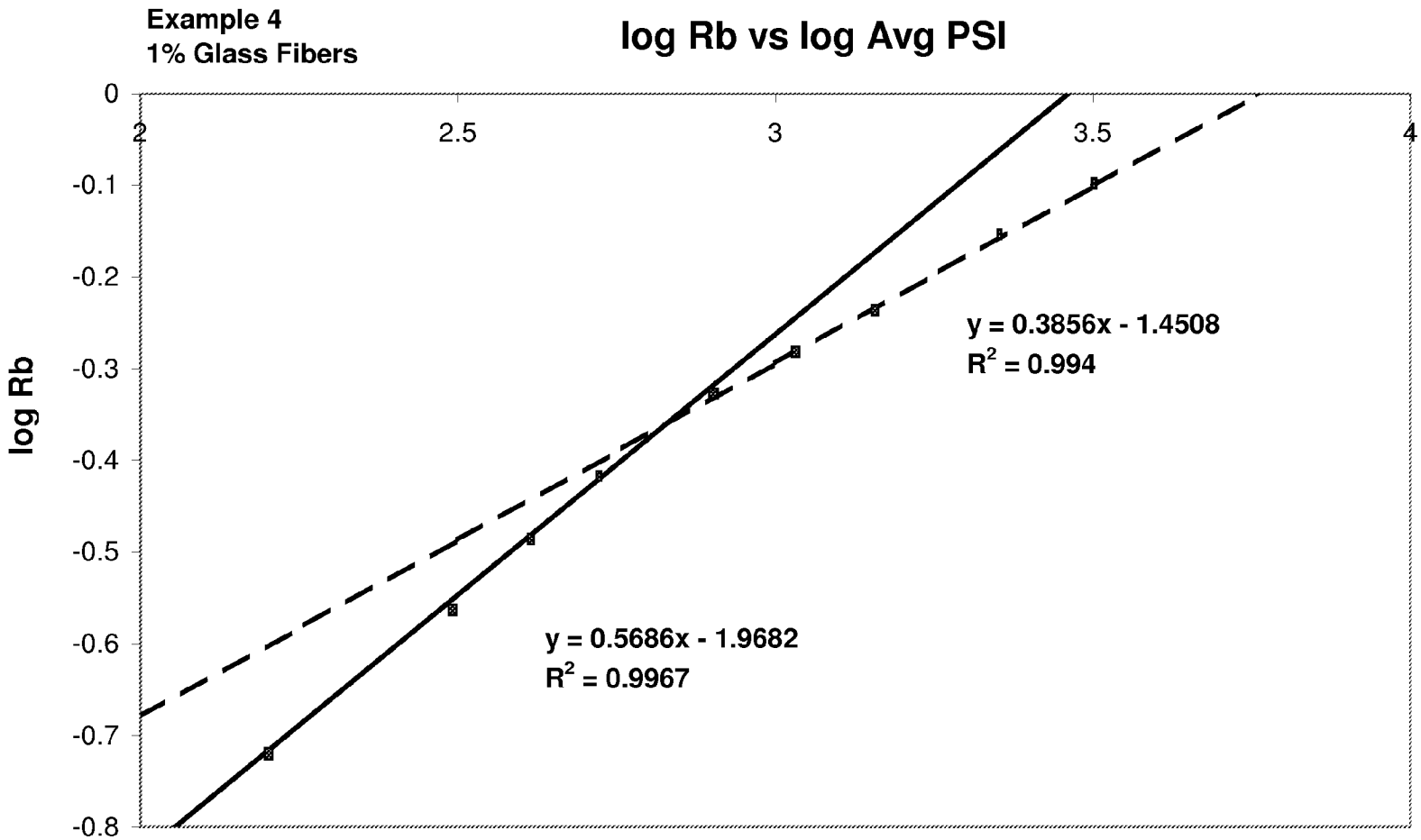
FIG. 5 is a combustion profile (logarithm of burn rate ($r_b$) versus a logarithm of pressure (P)) for a gas generant material having 1% by weight pressure sensitivity modifying glass fiber particles.
Figure 6:
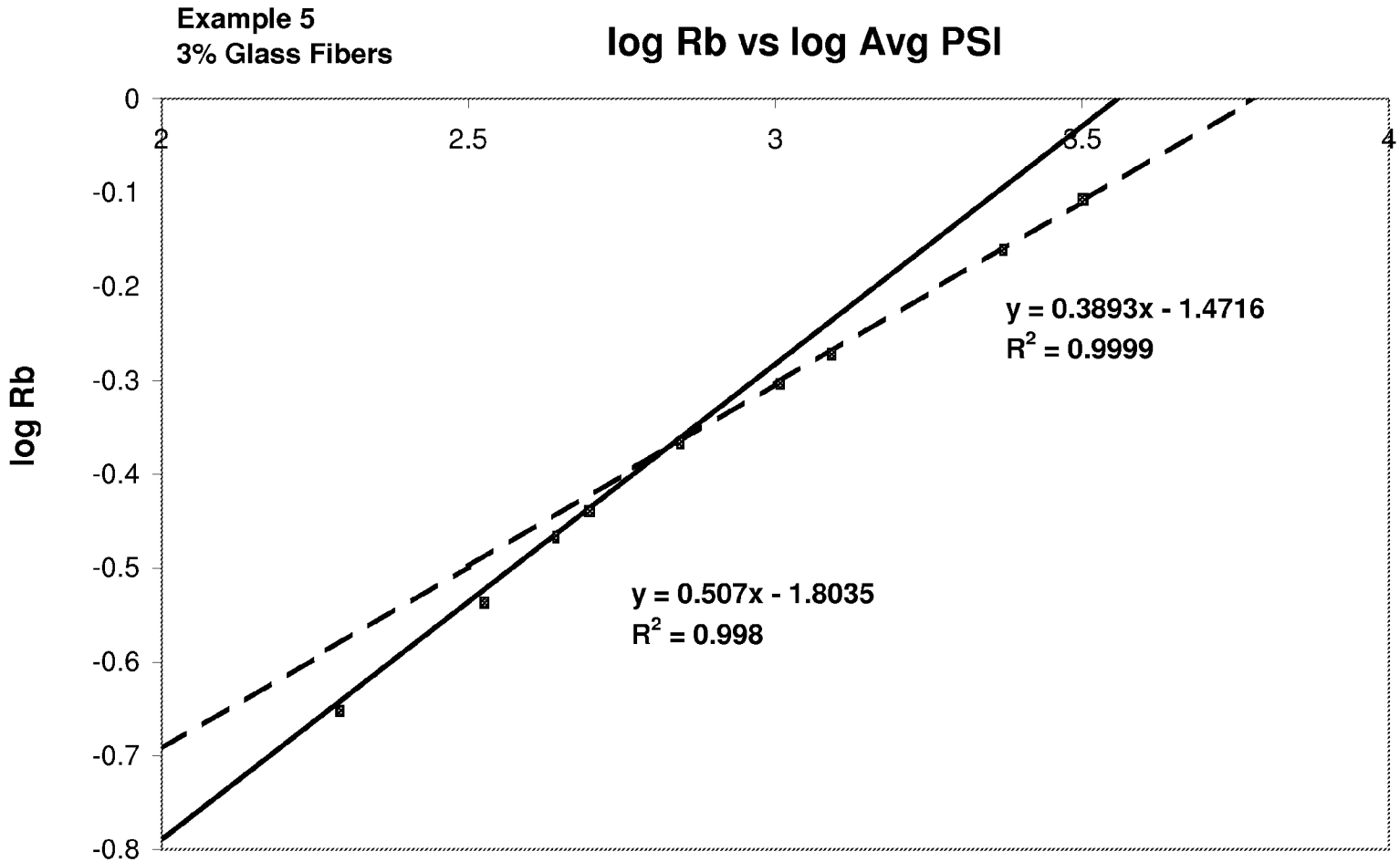
FIG. 6 is a combustion profile (logarithm of burn rate ($r_b$) versus a logarithm of pressure (P)) for a gas generant material having 3% by weight pressure sensitivity modifying glass fiber particles.
Figure 7:
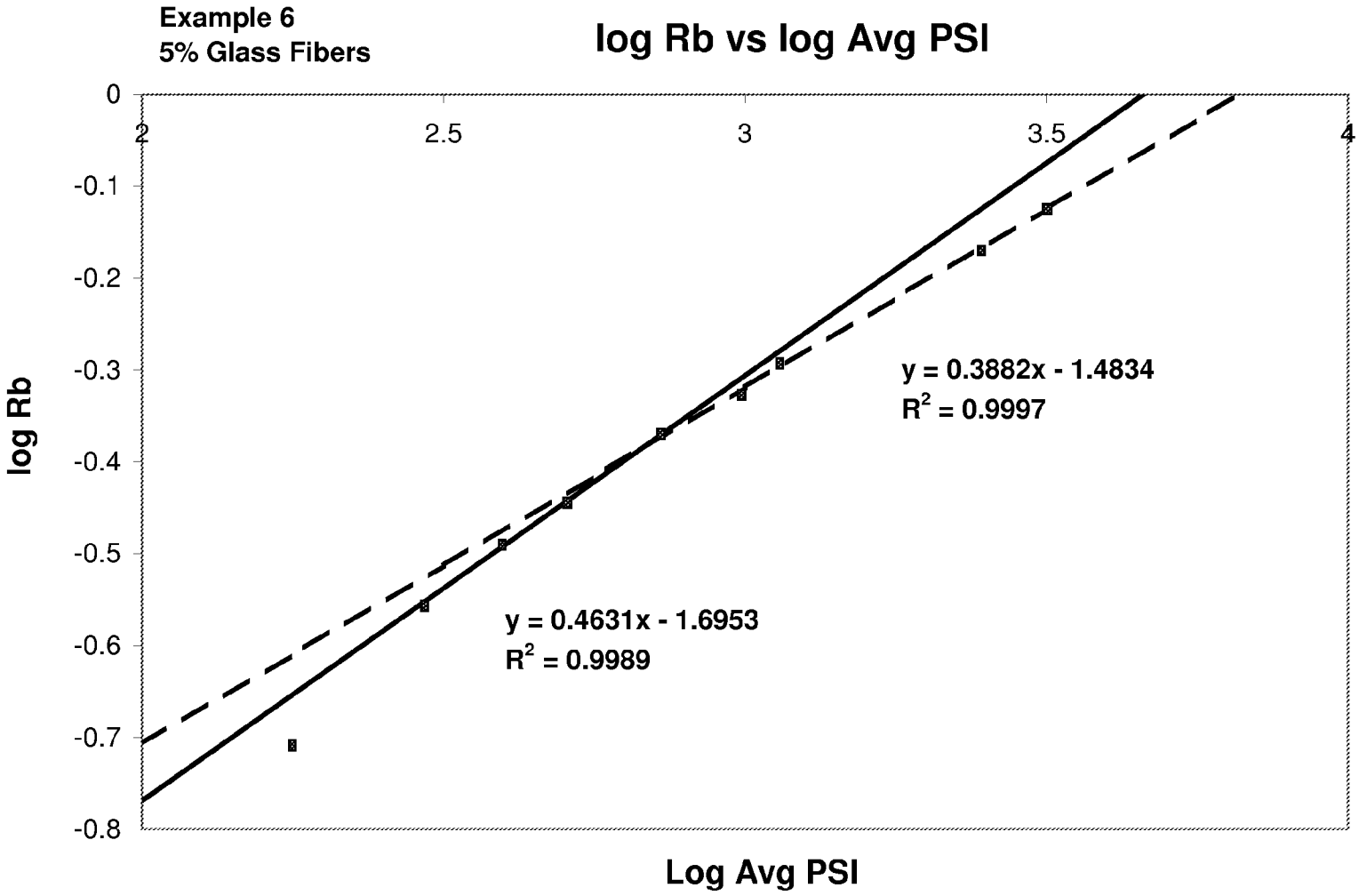
FIG. 7 is a combustion profile (logarithm of burn rate ($r_b$) versus a logarithm of pressure (P)) for a gas generant material having 5% by weight pressure sensitivity modifying glass fiber particles.

Each gas generant of Examples 4-6 and Comparative Example F are prepared to measure burn rate ($r_b$) and average pressure (P). FIG. 5 represents the logarithmic-logarithmic plot of $r_b$ versus P for Example 4, FIG. 6 represents the log-log plot of $r_b$ versus P of Example 5, FIG. 7 represents the log-log plot of $r_b$ versus P of Example 6; and FIG. 4 is the log-log plot of $r_b$ versus P for Comparative Example F. As can be seen in FIG. 4, for Comparative Example F, the initial slope ($n_1$') (during the initial burn rate, for example, log pressure below about 2.75) relates to the pressure exponent (n) of Equation 1. $n_1$' is about 0.6344 in FIG. 4. In certain aspects, it is desirable to reduce pressure sensitivity during the early and late stages of combustion, where the most pressure sensitivity is typically observed, as reflected by a reduction in the so-called "initial slope" ($n_1$). A subsequent slope (during later burning, where the log of pressure is greater than about 2.75) tends to typically be lower, thus exhibiting less pressure sensitivity, but may also be beneficially reduced by use of the pressure sensitivity modifying glass fibers. In FIG. 4, the subsequent slope ($n_2$') is about 0.4062. As can be seen in Table 5 and in the respective FIGS. 4 to 7, as the quantity of pressure sensitivity modifying glass fibers are added to the gas generant is increased, both the initial and subsequent pressure exponents ($n_1$, $n_2$) decrease, both at initial burning pressures and at later burning pressures.

Specifically, in accordance with certain aspects of the present disclosure, the pressure sensitivity modifying glass fibers stabilize combustion by lessening the pressure exponent at lower pressures by greater than about 5%, for example by greater than or equal to about 10% by adding 1 wt. % glass fiber to the gas generant composition; greater than or equal to about 20% by adding 3 wt. % glass fiber to the gas generant composition, and by about 27% by adding 5 wt. % glass fibers to the gas generant compositions.

While pressure sensitivity, as reflected by the pressure exponent (n) in Equation 1, varies depending on the gas generant materials employed, a material that generally exhibits pressure sensitivity during combustion has an initial linear burn rate pressure exponent ($n_1$) of greater than or equal to about 0.5, optionally greater than or equal to about 0.525, optionally greater than or equal to about 0.55, optionally greater than or equal to about 0.575, optionally greater than or equal to about 0.6, optionally greater than or equal to about 0.625, optionally greater than or equal to about 0.65, optionally greater than or equal to about 0.675, and in certain aspects, may be greater than or equal to about 0.7. Furthermore, in accordance with certain aspects of the present teachings, the initial linear burn rate pressure exponent $n_1$ is reduced to less than or equal to about 0.6, optionally reduced to less than or equal to about 0.575, optionally reduced to less than or equal to about 0.55, optionally reduced to less than or equal to about 0.525, optionally reduced to less than or equal to about 0.5, optionally reduced to less than or equal to about 0.475, in certain aspects, may be reduced to less than or equal to about 0.45, in certain aspects, optionally less than or equal to about 0.425, optionally less than or equal to about 0.4, and in certain aspects, optionally less than or equal to about 0.3. In certain aspects, the pressure sensitivity modifying glass fibers increase a burn rate constant (k) to greater than or equal to about 0.005, optionally to greater than or equal to about 0.006, optionally to greater than or equal to about 0.007, optionally to greater than or equal to about 0.008, and in certain aspects, to greater than or equal to about 0.009.

In various aspects, the present disclosure thus provides a gas generant that comprises at least one fuel and at least one oxidizer, where generant has a burn rate that is susceptible to pressure sensitivity during combustion. The gas generant further comprises a plurality of pressure sensitivity modifying glass fiber particles comprising silicon dioxide, aluminosilicates, borosilicates and/or calcium aluminoborosilicate distributed in the fuel mixture. In certain aspects, such glass fiber particles are present in the gas generant at greater than or equal to about 1% and less than about 10% by weight.

The plurality of pressure sensitivity modifying glass fibers reduces the pressure sensitivity of the fuel mixture during combustion, so that the gas generant composition has a linear burn rate pressure exponent of less than or equal to about 0.6, optionally less than or equal to about optionally reduced to less than or equal to about 0.575, optionally reduced to less than or equal to about 0.55, optionally reduced to less than or equal to about 0.525, optionally reduced to less than or equal to about 0.5, optionally reduced to less than or equal to about 0.475, in certain aspects, may be reduced to less than or equal to about 0.45, in certain aspects, optionally less than or equal to about 0.425, optionally less than or equal to about 0.4, and in certain aspects, optionally less than or equal to about 0.38. In yet other aspects, the linear burn rate pressure exponent is reduced in the fuel mixture susceptible to pressure sensitivity during combustion by at least about 3%, optionally reduced by greater than or equal to about 5%, optionally greater than or equal to about 10%, optionally greater than or equal to about 15%, optionally greater than or equal to about 20% optionally greater than or equal to about 25%, and in certain aspects, may be reduced by greater than or equal to about 30%.

In certain aspects, the inclusion of the plurality of pressure sensitivity modifying glass fibers to a gas generant material reduces the pressure sensitivity of the mixture, as reflected by an increase in the linear burn rate constant (k) by greater than or equal to about 50%, optionally greater than or equal to about 100%, optionally greater than or equal to about 150%, optionally greater than or equal to about 200% optionally greater than or equal to about 250%, optionally greater than or equal to about 300%, optionally greater than or equal to about 350%, and in certain aspects, an increase of greater than or equal to about 400%.

In certain embodiments, the gas generant composition comprises a plurality of pressure sensitivity modifying glass fiber particles having an average aspect ratio (AR) as described above, for example, in certain aspects, the AR may range from about 10:1 to about 50:1 and the glass fiber particles may have an average length of greater than or equal to about 10 μm and less than or equal to about 200 μm. In certain aspects, the plurality of pressure sensitivity modifying glass fiber particles comprise milled glass fibers, which desirably lessen pressure sensitivity of various gas generant compositions.

In yet other aspects, the present teachings provide methods for lessening burn rate pressure sensitivity in a gas generant. The method comprises introducing a plurality of pressure sensitivity modifying glass fiber particles, for example, comprising calcium aluminoborosilicate, to a mixture comprising at least one fuel and at least one oxidizer to form the gas generant. In certain aspects, the mixture has a burn rate that is susceptible to pressure sensitivity during combustion and after the pressure sensitivity modifying glass fibers are introduced, the gas generant composition has a linear burn rate pressure exponent of less than or equal to about 0.6.

In yet other aspects, the method further comprises spray drying an aqueous mixture comprising at least one fuel, at least one oxidizer, and a plurality of pressure sensitivity modifying glass fiber particles, as previously described above, to produce a powder. The powder is then pressed to produce a gas generant grain.

In certain aspects, another method further comprises spray drying an aqueous mixture comprising at least one fuel and at least one oxidizer, as described previously above, to produce a spray dried powder. The pressure sensitivity modifying glass fiber particles are mixed (e.g., dry blended or mixed) with the spray dried powder. The powder and pressure sensitivity modifying glass fiber particles are then pressed to produce a gas generant grain.

The examples and other embodiments described above are not intended to be limiting in describing the full scope of compositions and methods of this technology. Equivalent changes, modifications and variations of specific embodiments, materials, compositions, and methods may be made within the scope of the present disclosure with substantially similar results.

What is claimed is:

1. A gas generant composition comprising:

at least one fuel and at least one oxidizer, and a plurality of pressure sensitivity modifying milled glass fiber particles comprising a compound selected from the group consisting of aluminosilicate, borosilicate, calcium aluminoborosilicate and combinations thereof, wherein a comparative gas generant comprising said at least one fuel and said at least one oxidizer without said plurality of pressure sensitivity modifying milled glass fiber particles has a burn rate that is susceptible to pressure sensitivity during combustion and the gas generant has a reduced pressure sensitivity and/or increased combustion stability during combustion.

2. The gas generant composition of claim 1, wherein the gas generant composition has a linear burn rate pressure exponent of less than or equal to about 0.6.

3. The gas generant composition of claim 1, wherein said plurality of pressure sensitivity modifying milled glass fiber particles is present at greater than or equal to about 1% and less than about 10% by weight of the gas generant composition.

4. The gas generant composition of claim 3, wherein said fuel is about 40 to about 60 weight % of the total gas generant composition; said at least one oxidizer comprises a primary oxidizer and a secondary oxidizer, wherein said primary oxidizer is about 25 to about 60 weight % of the total gas generant composition and said secondary oxidizer is about 1 to about 20 weight % of the total gas generant composition.

5. The gas generant composition of claim 4, further comprising less than or equal to about 5% by weight of a slag promoting agent in the total gas generant composition and less than or equal to about 5% by weight of a lubricating or press release agent in the total gas generant composition.

6. The gas generant composition of claim 1, wherein said oxidizer comprises a primary oxidizer and a secondary oxidizer comprising a perchlorate-containing compound.

7. The gas generant composition of claim 6, wherein said fuel comprises guanidine nitrate; said primary oxidizer comprises basic copper nitrate; and said secondary oxidizer is selected from an alkali metal perchlorate or an ammonium perchlorate.

8. The gas generant composition of claim 1, wherein said plurality of pressure sensitivity modifying milled glass fiber particles has an average aspect ratio (AR) ranging from about 10:1 to about 50:1.

9. The gas generant composition of claim 1, wherein said plurality of pressure sensitivity modifying milled glass fiber particles has an average aspect ratio (AR) ranging from about 10:1 to about 20:1 and has a length of greater than or equal to about 3 μm.

10. The gas generant composition of claim 1, wherein said plurality of pressure sensitivity modifying milled glass fiber particles has a length of greater than or equal to about 10 μm and less than or equal to about 200 μm.

11. The gas generant composition of claim 1, wherein said plurality of pressure sensitivity modifying milled glass fiber particles comprise milled glass fibers comprising calcium aluminoborosilicate.

12. A gas generant comprising:

a mixture comprising at least one fuel and at least one oxidizer, wherein the mixture has a burn rate that is susceptible to pressure sensitivity during combustion;

a plurality of pressure sensitivity modifying milled glass fiber particles comprising at least one compound selected from the group consisting of silicon dioxide, aluminosilicate, borosilicate, calcium aluminoborosilicate, and combinations thereof, distributed in the fuel mixture at greater than or equal to about 1% and less than about 10% by weight, wherein the plurality of pressure sensitivity modifying milled glass fibers reduces said pressure sensitivity of said mixture during combustion, so that the gas generant composition has a linear burn rate pressure exponent of less than or equal to about 0.6.

13. The gas generant composition of claim 12, wherein said plurality of pressure sensitivity modifying milled glass fiber particles has an average aspect ratio (AR) ranging from about 10:1 to about 50:1 and an average length of greater than or equal to about 10 μm and less than or equal to about 200 μm.

14. The gas generant composition of claim 12, wherein said plurality of pressure sensitivity modifying milled glass fiber particles comprises calcium aluminoborosilicate.

15. The gas generant composition of claim 12, wherein said at least one oxidizer comprises a primary oxidizer and a secondary oxidizer comprising a perchlorate-containing compound.

16. The gas generant composition of claim 15, wherein said at least one fuel mixture comprises guanidine nitrate; said primary oxidizer comprises basic copper nitrate; said secondary oxidizer is selected from an alkali metal perchlorate or an ammonium perchlorate.

17. The gas generant composition of claim 12, wherein said at least one fuel is about 40 to about 60 weight % of the total gas generant composition; said at least one oxidizer comprises a primary oxidizer and a secondary oxidizer, wherein said primary oxidizer is about 25 to about 60 weight % of the total gas generant composition and said secondary oxidizer is about 1 to about 20 weight % of the total gas generant composition.

18. The gas generant composition of claim 4, wherein said secondary oxidizer comprises a perchlorate-containing compound.

19. A gas generant composition comprising:

at least one fuel and at least one oxidizer, and a plurality of pressure sensitivity modifying milled E-glass fiber particles comprising calcium aluminoborosilicate having a density of about 0.525 g/cm$^3$, wherein a comparative gas generant comprising the at least one fuel and the at least one oxidizer without the plurality of pressure sensitivity modifying milled E-glass fiber particles has a burn rate that is susceptible to pressure sensitivity during combustion and the gas generant has a reduced pressure sensitivity during combustion so that the gas generant composition has a linear burn rate pressure exponent of less than or equal to about 0.6.

20. The gas generant composition of claim 19, wherein the at least one fuel is present at about 40 to about 60% by weight of the total gas generant composition; the at least one oxidizer is present at about 25 to about 80% by weight, and the plurality of pressure sensitivity modifying milled E-glass fiber particles is present at greater than or equal to about 1% and less than about 10% by weight of the gas generant composition.

21. The gas generant composition of claim 20, wherein the at least one oxidizer comprises a primary oxidizer and a secondary oxidizer comprising a perchlorate selected from an alkali metal perchlorate or an ammonium perchlorate, wherein the primary oxidizer is present at about 25 to about 60 weight % of the total gas generant composition; and the secondary oxidizer is present at about 1 to about 20 weight % of the total gas generant composition.

22. A gas generant composition comprising:

at least one fuel and at least one oxidizer, and a plurality of pressure sensitivity modifying milled E-glass fiber particles comprising calcium aluminoborosilicate having a density of about 0.525 g/cm$^3$, wherein the plurality of pressure sensitivity modifying milled E-glass fiber particles comprises about 53.5% by weight silicon dioxide ($SiO_2$), about 8% by weight boron oxide ($B_2O_3$), about 14.5% by weight aluminum oxide ($Al_2O_3$), about 21.7% by weight calcium oxide (CaO), and about 1.1% by weight magnesium oxide (MgO), and wherein a comparative gas generant comprising the at least one fuel and the at least one oxidizer without the plurality of pressure sensitivity modifying milled E-glass fiber particles has a burn rate that is susceptible to pressure sensitivity during combustion and the gas generant has a reduced pressure sensitivity during combustion so that the gas generant composition has a linear burn rate pressure exponent of less than or equal to about 0.6.

23. A gas generant composition comprising:

at least one fuel, a primary oxidizer, a secondary oxidizer, and a plurality of pressure sensitivity modifying milled E-glass fiber particles comprising calcium aluminoborosilicate having a density of about 0.525 g/cm$^3$, wherein the fuel comprises 5-amino tetrazole present at about 24% by weight of the total gas generant composition, the primary oxidizer comprises ammonium nitrate present at about 65 to about 66% by weight of the total gas generant composition, the secondary oxidizer comprises potassium nitrate present at about 6 to about 7% by weight of the total gas generant composition, and the plurality of pressure sensitivity modifying milled E-glass fiber particles is present at about 3% by weight of the total gas generant composition, wherein a comparative gas generant comprising the at least one fuel, the primary oxidizer, and the secondary oxidizer without the plurality of pressure sensitivity modifying milled E-glass fiber particles has a burn rate that is susceptible to pressure sensitivity during combustion and the gas generant has a reduced pressure sensitivity during combustion so that the gas generant composition has a linear burn rate pressure exponent of less than or equal to about 0.6.

* * * * *